US010145597B2

(12) United States Patent
Hur et al.

(10) Patent No.: US 10,145,597 B2
(45) Date of Patent: Dec. 4, 2018

(54) INDOOR UNIT OF AIR CONDITIONER, CONTROL TERMINAL APPARATUS AND AIR CONDITIONING METHOD

(71) Applicant: SAMSUNG ELECTRONICS CO., LTD., Suwon (KR)

(72) Inventors: Jae-hun Hur, Yongin (KR); In-jung Baek, Seoul (KR); Jin-ho Lim, Suwon (KR); Min-gyu Kim, Suwon (KR); Yun-nam Kim, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 354 days.

(21) Appl. No.: 14/858,780

(22) Filed: Sep. 18, 2015

(65) Prior Publication Data

US 2016/0084551 A1 Mar. 24, 2016

(30) Foreign Application Priority Data

Sep. 19, 2014 (KR) ..... 10-2014-0125217
Jul. 22, 2015 (KR) ..... 10-2015-0103497

(51) Int. Cl.
*F25B 49/02* (2006.01)
*F24F 11/30* (2018.01)
(Continued)

(52) U.S. Cl.
CPC ..... *F25B 49/02* (2013.01); *F24F 11/006* (2013.01); *F24F 11/30* (2018.01); *F24F 11/62* (2018.01);
(Continued)

(58) Field of Classification Search
CPC .. F24F 11/006; F24F 2011/0067; F25B 49/02
(Continued)

(56) References Cited

U.S. PATENT DOCUMENTS 4,060,123 A * 11/1977 Hoffman ..... F24D 19/10 165/11.1
4,308,992 A * 1/1982 Horton ..... F24F 3/0442 165/11.1
(Continued)

FOREIGN PATENT DOCUMENTS

EP 0 660 051 A2 6/1995
EP 1 672 292 A2 6/2006
(Continued)

OTHER PUBLICATIONS

Extended European Search Report dated Feb. 24, 2016 in corresponding European Patent Application No. 15185952.7.

*Primary Examiner* — Henry Crenshaw
(74) *Attorney, Agent, or Firm* — Staas & Halsey LLP

(57) ABSTRACT

An indoor unit of an air conditioner including a plurality of indoor units and one outdoor unit connected to the plurality of indoor units to be operated as a cooling cycle or a heating cycle is provided. The indoor unit includes: a communicator receiving setting information for performing air conditioning in a room from a control terminal apparatus; and a controller determining whether the received setting information is valid setting information applicable to the indoor unit depending on whether the air conditioner is operated as the cooling cycle or the heating cycle and setting the setting information in the indoor unit depending on the determination result.

17 Claims, 15 Drawing Sheets

(51) Int. Cl.
*F24F 11/62* (2018.01)
*F24F 11/00* (2018.01)
*F24F 11/54* (2018.01)

(52) U.S. Cl.
CPC ..... *F24F 11/54* (2018.01); *F24F 2011/0067* (2013.01)

(58) Field of Classification Search
USPC ..... 165/11.1, 208; 62/160, 203, 159
See application file for complete search history.

(56) References Cited

U.S. PATENT DOCUMENTS 4,924,681 A * 5/1990 DeVit ..... F24D 15/04 62/238.6
4,930,317 A * 6/1990 Klein ..... A61F 7/00 62/259.3
5,050,394 A * 9/1991 Dudley ..... F24D 17/02 62/115
5,860,473 A * 1/1999 Seiden ..... F24F 11/006 165/208
2002/0124992 A1* 9/2002 Rainer ..... F24F 11/006 165/11.1
2004/0065095 A1* 4/2004 Osborne ..... F24F 3/00 62/160
2005/0040247 A1* 2/2005 Pouchak ..... F24F 11/006 236/44 C
2005/0229871 A1* 10/2005 Robertson ..... F24D 3/08 122/32
2009/0188027 A1* 7/2009 Katsumi ..... F24F 1/022 4/218
2010/0191551 A1* 7/2010 Drance ..... G06Q 10/02 705/5
2013/0091883 A1* 4/2013 Perez ..... F25B 30/02 62/203
2014/0129197 A1* 5/2014 Sons ..... G06F 17/5004 703/7

FOREIGN PATENT DOCUMENTS

JP 2000-171075 6/2000
JP 3549710 8/2004
JP 2010-107124 5/2010
KR 10-2009-0029070 * 3/2009

* cited by examiner

FIG. 8

| SETTING INFORMATION / DEDICATED MODE | AUTOMATIC OPERATION | COOLING OPERATION | DEHUMIDIFICATION OPERATION | BLOWING OPERATION | HEATING OPERATION |
|---|---|---|---|---|---|
| COOLING | VALID | VALID | VALID | VALID | INVALID |
| HEATING | VALID | INVALID | INVALID | VALID | VALID |

INDOOR UNIT OF AIR CONDITIONER, CONTROL TERMINAL APPARATUS AND AIR CONDITIONING METHOD

CROSS-REFERENCE TO RELATED APPLICATIONS

This application claims the benefit of priority under 35 U.S.C. § 119 from Korean Patent Application No. 10-2014-0125217, filed on Sep. 19, 2014, and Korean Patent Application No. 10-2015-0103497, filed on Jul. 22, 2015, in the Korean Intellectual Property Office, the disclosure of which is incorporated herein by reference in its entirety.

BACKGROUND

Field

Apparatuses and methods consistent with the present disclosure relate to an indoor unit of an air conditioner, a control terminal apparatus, and an air conditioning method, and more particularly, to an indoor unit, an air conditioner, a control terminal apparatus, and an air conditioning method capable of determining whether setting information of an indoor unit by a user is valid on the basis of an operating state of an outdoor unit.

Description of Related Art

An air conditioner is disposed in a space such as a house, an office, a shop, and a house in which crops may be raised to control temperature, humidity, cleanliness, and air current of air, thereby helping keep indoor environment under which people may pleasantly reside or indoor environment under which crops may be appropriately grown.

In recent years, as a scale of buildings is getting larger and tries to reduce an area occupied by the outdoor unit are conducted, a multi-air conditioner in which a plurality of indoor units are connected to one outdoor unit has been widely used.

However, the multi-air conditioner commonly uses one outdoor unit, and therefore the plurality of indoor units need to be operated in the same cycle mode. That is, when one indoor unit is operated in a cooling mode using a cooling cycle, other indoor units may not be used as a heating mode using a heating cycle.

However, a controller setting or controlling operation states of an enormous number of air conditioners in large-scale buildings like a hotel is designed to be able to control various types of air conditioners, and therefore the corresponding controllers may receive the set values which may not be applied to each indoor unit. In this case, there is a problem in that the indoor unit may have an error or perform air conditioning different from the user's or manager's intention.

Meanwhile, the accommodations like a hotel or a motel try to provide guests with better lodging and meals environment. However, if an unused room is not air condition, it would be filled with hot air or cold air depending on the seasonal or climatic environment of the corresponding area. As a result, a customer who checks into an empty room that has not been air conditioned may feel displeasure when entering the room.

SUMMARY

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides an indoor unit of an air conditioner, a control terminal apparatus, and an air conditioning method capable of determining whether information of the indoor unit set by a user is valid depending on an operating state of an outdoor unit.

According to an aspect of the present disclosure, an indoor unit of an air conditioner including a plurality of indoor units and one outdoor unit connected to the plurality of indoor units to be operated as a cooling cycle or a heating cycle, the indoor unit includes: a communicator receiving setting information for performing air conditioning in a room from a control terminal apparatus; and a controller determining whether the received setting information is valid setting information applicable to the indoor unit depending on whether the air conditioner is operated as the cooling cycle or the heating cycle and setting the setting information in the indoor unit depending on the determination result.

The controller may determine the received setting information as invalid setting information, if the outdoor unit receives setting information including an operation mode to be operated as the heating cycle, when the outdoor unit is operated as the cooling cycle and determine the received setting information as the invalid setting information, if the outdoor unit receives setting information including an operation mode to be operated as the cooling cycle, when the outdoor unit is operated as the heating cycle.

The controller may determine the setting information including the operation mode for the outdoor unit to be operated as the heating cycle as the valid setting information, even though the outdoor unit is operated as the cooling cycle, if the indoor unit includes a hot water circulating pump or heat rays.

The controller may perform air conditioning depending on the received setting information, if other indoor units connected to the outdoor unit are not operated.

The setting information may include at least one of an operation mode for the indoor unit to perform the air conditioning by any one of a cooling operation, a heating operation, a dehumidification operation, and a blowing operation, setting temperature for setting user's desired indoor temperature, and an air volume for setting wind strength discharged from the indoor unit and the controller may determine whether the received setting temperature is within a predetermined temperature range applicable to the indoor unit based on the operation mode.

The indoor unit may further include: a storage storing the set setting information, in which the controller may perform a control to perform the air conditioning in an empty room state depending on the stored setting information in response to a signal which represent a card key is not sensed by a key tag sensor in a room in which the indoor unit is installed.

The indoor unit may further include: a storage storing the set setting information, in which the controller may perform a control to perform the air conditioning of an entering schedule state depending on the stored setting information, in response to a signal about payment completion or the reservation confirmation of the room for entering a room in which the indoor unit is installed from an external apparatus of a front.

According to another aspect of the present disclosure, a control terminal apparatus controlling a plurality of indoor units, respectively, in an air conditioner including the plurality of indoor units and one outdoor unit connected to the plurality of indoor units and operated as a cooling cycle or a heating cycle, the control terminal apparatus includes: a manipulator receiving setting information on one of the plurality of indoor units; a communicator receiving refrigerant cycle information of the outdoor unit corresponding to the indoor unit receiving the setting information; and a controller controlling the communicator to determine whether the received setting information is valid setting information applicable to the indoor unit depending on whether the outdoor unit performs the cooling cycle or the heating cycle and set the received setting information in the indoor unit depending on the determination result.

The controller may determine the received setting information as invalid setting information, if the outdoor unit receives setting information including an operation mode to be operated as the heating cycle, when the outdoor unit is operated as the cooling cycle and determine the received setting information as the invalid setting information, if the outdoor unit receives setting information including an operation mode to be operated as the cooling cycle, when the outdoor unit is operated as the heating cycle.

The controller may determine the setting information including the operation mode for the outdoor unit to be operated as the heating cycle as the valid setting information, even though the outdoor unit is operated as the cooling cycle, if the indoor unit includes a hot water circulating pump or heat rays.

The controller may control the communicator to be set in the indoor unit depending on the received setting information, if other indoor units connected to the outdoor unit are not operated.

The setting information may include at least one of an operation mode for the indoor unit to perform the air conditioning by any one of a cooling operation, a heating operation, a dehumidification operation, and a blowing operation, setting temperature for setting user's desired indoor temperature, and an air volume for setting wind strength discharged from the indoor unit and the controller may determine whether the received setting temperature is within a predetermined temperature range applicable to the indoor unit based on the operation mode.

According to still another aspect of the present disclosure, an air conditioning method of an indoor unit of an air conditioner including a plurality of indoor units and one outdoor unit connected to the plurality of indoor units to be operated as a cooling cycle or a heating cycle, the air conditioning method includes: receiving setting information for performing air conditioning in a room from a control terminal apparatus; determining whether the received setting information is the valid setting information applicable to the indoor unit depending on whether the air conditioner is operated as the cooling cycle or the heating cycle; and setting the setting information in the indoor unit depending on the determination result.

In the determining, when the outdoor unit is operated as the cooling cycle, if the outdoor unit receives setting information including an operation mode to be operated as the heating cycle, the received setting information may be determined as invalid setting information and when the outdoor unit is operated as the heating cycle, if the outdoor unit receives setting information including an operation mode to be operated as the cooling cycle, the received setting information may be determined as the invalid setting information.

In the determining, if the indoor unit includes a hot water circulating pump or heat rays, even though the outdoor unit is operated as the cooling cycle, the setting information including the operation mode for the outdoor unit to be operated as the heating cycle may be determined as the valid setting information.

The air conditioning method may further include: performing air conditioning depending on the received setting information, if other indoor units connected to the outdoor unit are not operated.

The setting information may include at least one of an operation mode for the indoor unit to perform the air conditioning by any one of a cooling operation, a heating operation, a dehumidification operation, and a blowing operation, setting temperature for setting user's desired indoor temperature, and an air volume for setting wind strength discharged from the indoor unit and in the determining, it may be determined whether the received setting temperature is within a predetermined temperature range applicable to the indoor unit based on the operation mode.

The air conditioning method may further include: storing the set setting information; and performing a control to perform the air conditioning in an empty room state depending on the stored setting information in response to a signal which does not sense a card key by a key tag sensor in a room in which the indoor unit is installed.

The air conditioning method may further include: storing the set setting information; and performing a control to perform the air conditioning of an entering schedule state depending on the stored setting information, in response to a signal of payment completion or the reservation confirmation of the room for entering a room in which the indoor unit is installed from an external apparatus of a front.

According to still yet another aspect of the present disclosure there are provided computer readable recording media including programs for executing an air conditioning method of an indoor unit of an air conditioner performing a cooling cycle or a heating cycle by connecting a plurality of indoor units to one outdoor unit, in which the conditioning method of the indoor unit includes: receiving setting information for performing air conditioning a room from a control terminal apparatus; determining whether the received setting information is the valid setting information applicable to the indoor unit depending on whether the air conditioner is operated as the cooling cycle or the heating cycle; and setting the setting information in the indoor unit depending on the determination result.

Additional and/or other aspects and advantages of the disclosure will be set forth in part in the description which follows and, in part, will be obvious from the description, or may be learned by practice of the disclosure.

BRIEF DESCRIPTION OF THE DRAWING FIGURES

The above and/or other aspects of the present disclosure will be more apparent by describing certain exemplary embodiments of the present disclosure with reference to the accompanying drawings, in which:

FIG. 8 is a table for describing criteria determining validity of setting information according to an exemplary embodiment of the present disclosure;

DESCRIPTION OF EMBODIMENTS

Hereinafter, exemplary embodiments of the present disclosure will be described in more detail with reference to the accompanying drawings.

Figure 1:
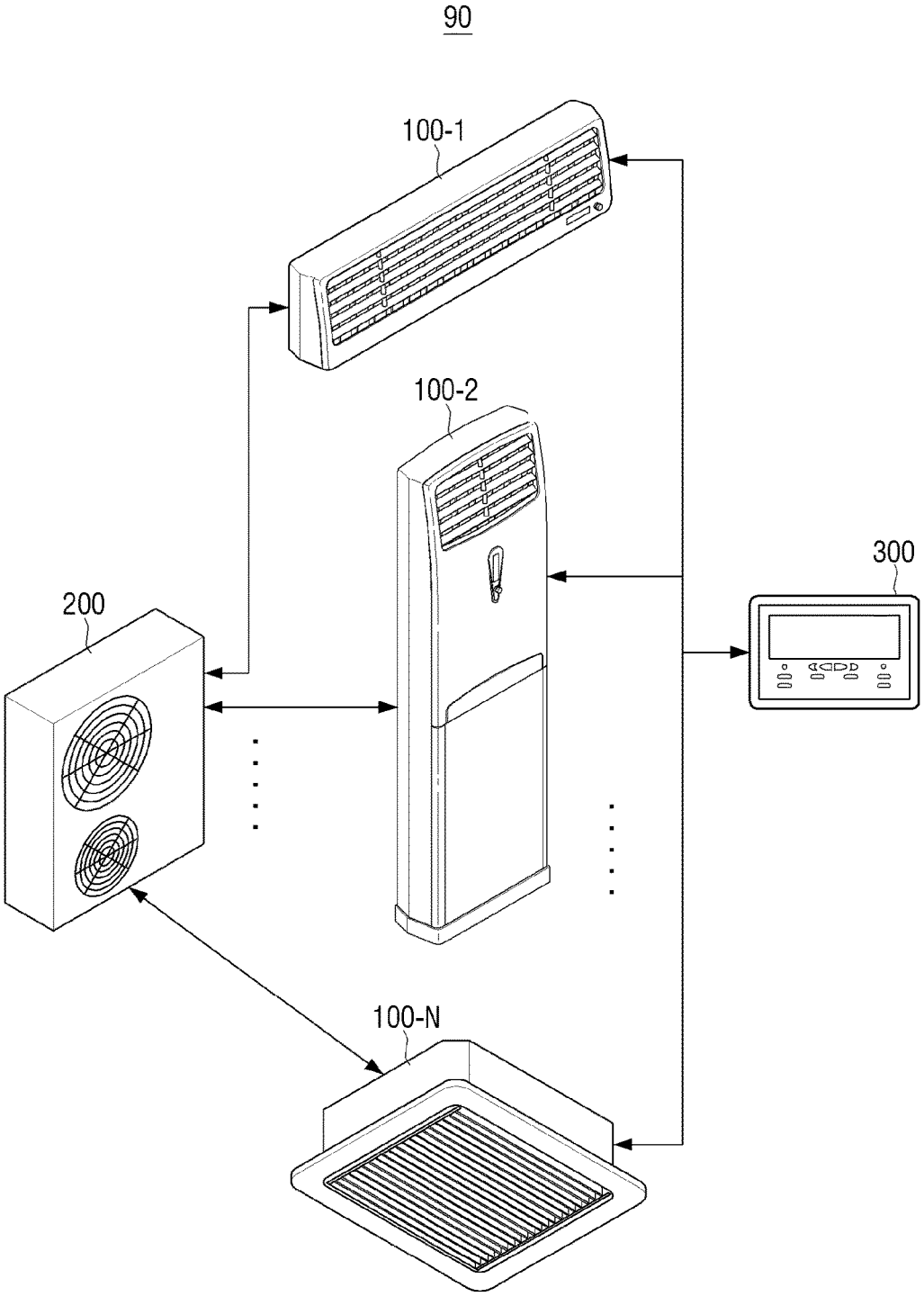
FIG. 1 is a diagram illustrating an air conditioning system according to an exemplary embodiment of the present disclosure.

FIG. 1 is a diagram illustrating an air conditioning system according to an exemplary embodiment of the present disclosure.

Referring to FIG. 1, an air conditioning system 90 includes a plurality of indoor units 100-1, 100-2, . . . , 100-N, an outdoor unit 200, and a control terminal apparatus 300.

The plurality of indoor units 100-1, 100-2, . . . , 100-N are connected to one outdoor unit 200. In detail, the plurality of indoor units 100-1, 100-2, . . . , 100-N may exchange a refrigerant with the outdoor unit 200. In this case, the plurality of indoor units 100-1, 100-2, . . . , 100-N may each be connected to each other through a pipe for exchanging a refrigerant with the outdoor unit 200. Meanwhile, although an illustrated example illustrates and describes that each of indoor units 100-1, 100-2, . . . , 100-N are connected to the outdoor unit 200 in parallel through a pipe, upon implementation, the plurality of indoor units 100-1, 100-2, . . . , 100-N are connected to the outdoor unit 200 in series through the pipe, such that a refrigerant may be circulated to the outdoor unit 200 through all the indoor units 100-1, 100-2, . . . , 100-N.

Further, the plurality of indoor units 100-1, 100-2, . . . , 100-N may transmit and receive information for performing the air conditioning operation to and from the outdoor unit 200. The plurality of indoor units 100-1, 100-2, . . . , 100-N are disposed indoors to perform an operation for conditioning indoor air. In detail, the plurality of indoor units 100-1, 100-2, . . . , 100-N may perform at least one air conditioning of cooling lowering a temperature of indoor air, heating raising the temperature of indoor air, blowing forming air current in a room, and dehumidification lowering indoor humidity.

The plurality of indoor units 100-1, 100-2, . . . , 100-N may each be different kind. For example, the first indoor unit 100-1 may be a wall hanging type, the second indoor unit 100-2 may be a stand type, and an N-type indoor unit 100-N may be a ceiling type cassette. In addition, the plurality of indoor units 100-1, 100-2, . . . , 100-N may include a duct type indoor unit and a floor type indoor unit.

The outdoor unit 200 exchanges heat with outer air. In detail, the outdoor unit 200 may exchange outer air with heat through a cooling cycle in which heat delivered from at least one of the plurality of indoor units 100-1, 100-2, . . . , 100-N through a refrigerant is emitted to the outside or exchange heat with outer air through a heating cycle in which the refrigerant absorbs lost heat from the outside.

The control terminal apparatus 300 controls the plurality of indoor units 100-1, 100-2, . . . , 100-N. In detail, the control terminal apparatus 300 may control at least one of the plurality of indoor units 100-1, 100-2, . . . , 100-N to perform air conditioning. Further, the control terminal apparatus 300 may transfer setting information of air conditioning to be performed by the indoor unit to at least one of the plurality of indoor units 100-1, 100-2, . . . , 100-N.

The control terminal apparatus 300 performs communication with the indoor unit 100. In detail, the control terminal apparatus 300 may perform communications with the plurality of indoor units 100-1, 100-2, . . . , 100-N using local area network communication. Alternatively, the control terminal apparatus 300 may perform direct communication with the plurality of indoor units 100-1, 100-2, . . . , 100-N of an air conditioner, respectively. In this case, the control terminal apparatus 300 may perform communication with each indoor unit by a pre-established wireless communication scheme. The control terminal apparatus 300 receives setting information for air conditioning of the indoor unit 100. In detail, the control terminal apparatus 300 provides a user with an interface which may set a scheme of enabling the indoor unit 100 to perform air conditioning, such that the user may input the setting information.

As described above, in the air conditioning system 90, the plurality of indoor units 100-1, 100-2, . . . , 100-N having different performance and kinds are connected to one outdoor unit and the control terminal apparatus 300 may transfer setting information for performing air conditioning to the plurality of indoor units 100-1, 100-2, . . . , 100-N, respectively. For example, the air conditioning system 90 may provide restrictive setting options depending on an operating state of the outdoor unit and transmit the setting information suitable for each indoor unit having different performance.

Meanwhile, although FIG. 1 illustrates that three indoor units are connected to one outdoor unit, upon implementation, two indoor units may be connected to one outdoor unit and more than four indoor units may also be connected to one outdoor unit. Further, although the illustrated example illustrates that one outdoor unit is connected to the plurality of indoor units, upon implementation, the form that at least two outdoor units are connected to a plurality of indoor units may be implemented.

Figure 2:
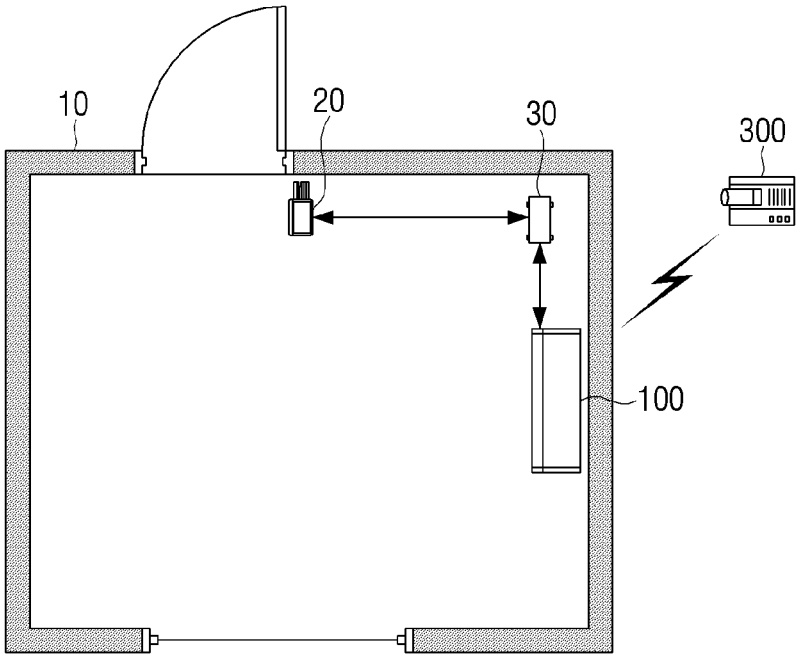
FIG. 2 is a diagram illustrating an air conditioning system having an indoor unit installed in a room according to an exemplary embodiment of the present disclosure.

FIG. 2 is a diagram illustrating an air conditioning system having an indoor unit installed in a room according to an exemplary embodiment of the present disclosure.

Referring to FIG. 2, a key tag sensor 20, a key tag controller 30, and the indoor unit 100 are installed in one room 10. Further, for convenience of explanation, FIG. 2 also illustrates an external control terminal apparatus 300 which is not installed in the room 10.

The room 10 may be any one room 10 in a house in which a plurality of rooms are present. Alternatively, the room 10 may be any one of several rooms of a hotel in which guests temporarily stay.

Further, the indoor unit 100 performs air conditioning in the room 10. Meanwhile, the indoor unit 100 may be connected to one outdoor unit 200 along with other indoor units which are installed in other rooms.

The key tag sensor 20 may be inserted with a key which locks an entrance door of the room 10. Further, the key tag sensor 20 may transfer an on/off signal to the key tag controller 30 depending on whether a key card is inserted into the key tag sensor 20.

The key tag controller 30 transmits empty room state information to the indoor unit 100. In detail, the key tag controller 30 may transmit information representing the empty room state to the indoor unit 100 depending on the sensing signal of the key tag sensor 20. For example, when the key card is pulled out from the key tag sensor 20, the key tag controller 30 may transmit information for conversion into the empty room state based on the received off signal to the indoor unit 100.

Meanwhile, the direct transmission of information informing the empty room state to the indoor unit 100 is illustrated and described above, but upon implementation, the empty room information may be transmitted to the control terminal apparatus 300 and the control terminal apparatus 300 may also transmit a signal for controlling the empty room to the indoor unit based on the received empty room information.

According to the exemplary embodiment of the present disclosure, the key tag sensor 20 has been used to sense the empty room state, but a sensor disposed around the entrance door sensing users' motions in the room 10 and a door lock controller sensing a door lock of an entrance door and whether the door lock is locked, etc., may also be used to sense whether guests check-out a room.

The indoor unit 100 performs air conditioning in the room 10. Further, when receiving the empty room information from the key tag controller 30, the indoor unit 100 may perform the air conditioning depending on air conditioning options corresponding to the empty room state.

The control terminal apparatus 300 controls the indoor unit 100. In detail, the control terminal apparatus 300 may transmit a command corresponding to the setting information set by a hotel manager or a resident to the indoor unit 100 to control the indoor unit 100. Here, the input setting information may include setting information for setting the air conditioning performance of the indoor unit to create user's desired indoor environment in the state in which the user checks into the room 10 and information for setting air conditioning performance in the empty room state so as to suppress mould in the room 10 from growing and gain a health purpose like ventilation of air even when guests check out the room 10 or so as to make a resident feel a pleasant mood when guests check-out a room and again check-in a room.

The control terminal apparatus 300 may be a mobile terminal apparatus. In this case, the control terminal apparatus 300 may transmit the setting information for controlling the indoor unit 100 outside and inside the room 10. For example, the hotel manager may approach several indoor units 100 installed each room 10 within a coverage area while carrying the control terminal apparatus 300 to input the setting information for performing air conditioning on each indoor unit 100.

Meanwhile, the mobile control terminal apparatus 300 may perform direct local area wired/wireless communications with the indoor unit 100 to set the air conditioning operation of the indoor unit 100. Alternatively, the mobile control terminal apparatus 300 may perform communication with the indoor unit 100 connected to a network terminal through a local area network in a building unit, a wide area internet network, a mobile communication network, etc., to set the air conditioning operation.

According to another exemplary embodiment of the present disclosure, the control terminal apparatus 300 may be implemented as a stationary central control terminal apparatus which monitors and controls cooling and heating of a building. For example, a plurality of indoor units installed in each room in accommodations like a hotel are connected to a hotel intranet and the control terminal apparatus 300 may access the hotel intranet to perform communication with the plurality of indoor units.

In connection with the control of the indoor unit 100 as described above, starting conditions for entering the empty room state may be implemented by the existing key tag apparatuses 20 and 30 and the indoor unit 100 alone may perform the air conditioning in the empty room state without complicated communication between the indoor unit 100 and the control terminal apparatus 300 only by inputting the air conditioning setting to the indoor unit 100 upon the empty room.

Figure 3:
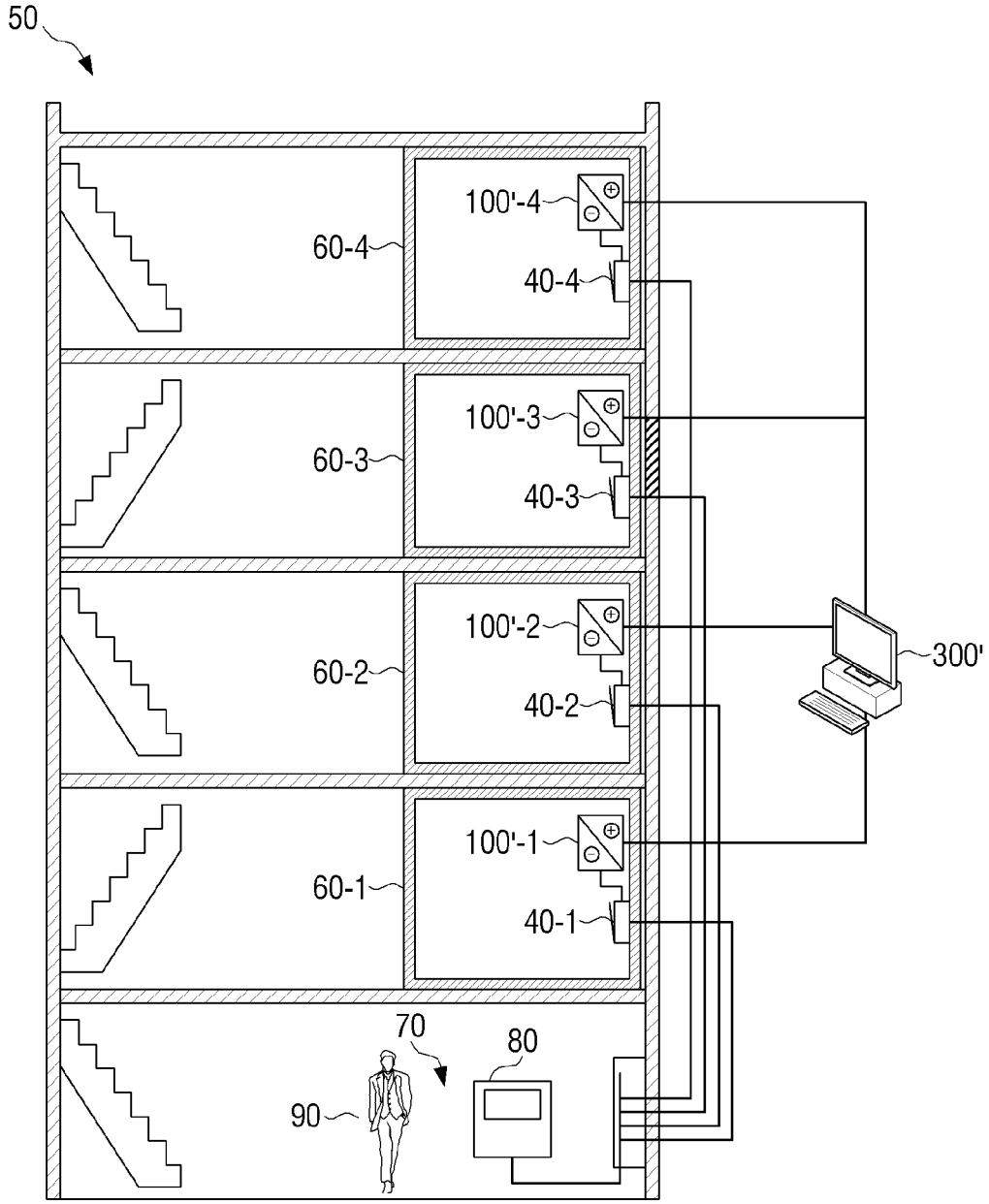
FIG. 3 is a diagram illustrating an air conditioning system having indoor units installed in a plurality of rooms of a hotel according to another exemplary embodiment of the present disclosure.

FIG. 3 is a diagram illustrating an air conditioning system having indoor units installed in a plurality of rooms of a hotel according to another exemplary embodiment of the present disclosure.

Referring to FIG. 3, a hotel 50 including a front 70 and a plurality of rooms 60-1, 60-2, 60-3, and 60-4 includes an approval system 80 disposed at the front 70, indoor units 100'-1, 100'-2, 100'-3, and 100'-4 installed in each of rooms 60-1, 60-2, 60-3, and 60-4, remote controllers 40-1, 40-2, 40-3, and 40-4, and a control terminal apparatus 300'.

The rooms 60-1, 60-2, 60-3, and 60-4 mean a room in which guests stay. The rooms 60-1, 60-2, 60-3, and 60-4 are provided with the remote controllers 40-1, 40-2, 40-3, and 40-4 which may control various kinds of electronic apparatuses installed in the rooms 60-1, 60-2, 60-3, and 60-4.

The remote controllers 40-1, 40-2, 40-3, and 40-4 may be implemented as the key tag apparatus. In detail, the remote controllers 40-1, 40-2, 40-3, and 40-4 which may control power supplies for electronic apparatuses such as lighting, a refrigerator, a cooler and heater, and TV of each of the rooms 60-1, 60-2, 60-3, and 60-4 may be implemented as the key tag apparatus sensing a key card for entrance and exit of the rooms 60-1, 60-2, 60-3, and 60-4.

The control terminal apparatus 300' controls an air conditioner. In detail, the control terminal apparatus 300' may control the air conditioning performance of the air conditioner configured of the indoor unit 100' and the outdoor unit (not illustrated). To this end, the control terminal apparatus 300' performs communication with a plurality of indoor units 100'-1, 100'-2, 100'-3, and 100'-4. Further, the control terminal apparatus 300' receives setting of options for air conditioning performance. In detail, the control terminal apparatus 300' may receive setting information for setting the options of the indoor unit 100' for air conditioning of each of the rooms 60-1, 60-2, 60-3, and 60-4. The setting information input to the control terminal apparatus 300' is transmitted to at least one of the indoor units 100'-1, 100'-2, 100'-3, and 100'-4 to be set.

In the exemplary embodiment of FIG. 3, the control terminal apparatus 300' receives setting information for setting an entering control. In detail, the control terminal apparatus 300' may receive the setting information for air conditioning of a room which a user is scheduled to enter. According to the exemplary embodiment of the present disclosure, the entering control means the control of the air conditioner for performing air conditioning of an empty room for a time when a new guest is scheduled to enter a room from a timing when he/she starts to check-in an unused empty room after check-out until he/she enters a room. The entering control may start the air conditioning in advance as soon as it is confirmed that a guest 90 enters an empty room 60 on which air conditioning is not performed to provide pleasant indoor environment.

According to the exemplary embodiment of the present disclosure, the guest 90 entering the front 70 of the hotel 50 uses the terminal 80 of the approval system to perform cost payment for the use of the empty room 60. Alternatively, the guest 90 uses the terminal 80 to perform personal identification of the reserved room 60. As an example, it is assumed that the guest 90 stays in room 60-1. If a payment of a room charge is completed or the personal identification is completed, the terminal 80 transmits a signal to the remote controller 40-1 of the room 60-1 which is designated by the guest 90. The remote controller 40-1 receiving a signal scheduling the entering of the guest 90 transmits a signal starting air conditioning for the entering control to the indoor unit 100'-1. The indoor unit 100'-1 performs the air conditioning before the guest 90 enters a room.

The indoor unit 100'-1 performs the air conditioning of the room 60-1 which the guest 90 is scheduled to enter. In this case, the indoor unit 100'-1 performs the air conditioning depending on the setting information transmitted from the control terminal apparatus 300'. For example, the indoor unit 100'-1 may perform an operation of circulating air with a high air volume like a turbo mode for fast air conditioning.

The guest 90 enters the room 60-1 using the offered card key and then inserts the card key into the remote controller (that is, key tag apparatus 40-1). The remote controller 40-1 transmits a signal sensing the card key to the indoor unit 100'-1. The indoor unit 100'-1 ends the air conditioning in the entering schedule state and is converted into a general mode.

According to the exemplary embodiment as described above, the accommodations 50 are not limited to a hotel but may include a pension, a hostel, etc, having a plurality of accommodations. Further, a system for confirming whether the guest 90 stays in the room 60 is not limited to an approval system and a reservation confirmation system and therefore all sensing means which may sense a visit of a guest and designate a room in which the guest stays while the guest finds a key placed in the lobby may be used.

Figure 4:
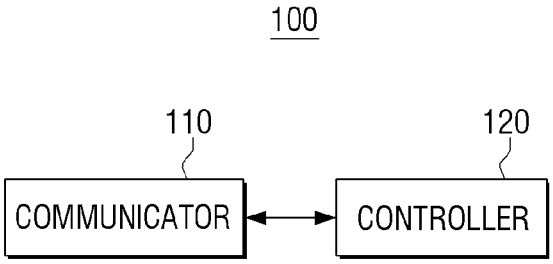
FIG. 4 is a block diagram illustrating a simple configuration of an indoor unit according to an exemplary embodiment of the present disclosure.

FIG. 4 is a block diagram illustrating a simple configuration of the indoor unit according to the exemplary embodiment of the present disclosure.

Referring to FIG. 4, the indoor unit 100 includes a communicator 110 and a controller 120.

The communicator 110 receives the setting information for performing air conditioning in a room. In detail, the communicator 110 may receive the setting information for the indoor unit of the air conditioner to perform air conditioning in a room from the control terminal apparatus which may control the plurality of indoor units.

Here, the setting information is information for setting options of an operation for the air conditioner including the indoor unit 100 to perform air conditioning. The setting information may include information for setting a cycle in which the refrigerant of the air conditioner is circulated to any one of a cooling cycle and a heating cycle, information for setting wind strength discharged from the indoor unit 100, and setting temperature in a room to be maintained by the air conditioner upon cooling and heating.

Further, the setting information may include at least one of an operation mode for the indoor unit to perform air conditioning by any one of a cooling operation, a heating operation, a dehumidification operation, and a blowing operation, setting temperature setting user's desired indoor temperature, and an air volume for setting wind strength discharged from the indoor unit. Further, the setting information may further include an automatic operation of automatically selecting a kind of operations by sensing at least one of temperature, humidity, air volume, and wind direction in the room.

Here, the above operation mode means any one of a cooling operation of performing indoor cooling through a cooling cycle, a dehumidification operation of performing dehumidification using the principle that vapor in air is condensed on a cold surface, a heating operation of performing indoor heating through a heating cycle, and a blowing operation of sucking indoor air and discharging the indoor air to form an air current in a room.

The communicator 110 may be formed to perform communication with the control terminal apparatus through a local area network (LAN) and the Internet network and communication through a universal serial bus (USB) port or a wireless port. Further, the communicator 110 may perform communication depending on standards such as WiFi, Bluetooth, Zigbee, infrared data association (IrDA) which are a kind of near field communication (NFC), RF like UHF and VHF, and ultra wideband (UWB).

The communicator 110 receives the signal of the key tag controller recognizing whether the card key of the room is inserted. In detail, the communicator 110 may receive the sensed signal from the key tag controller which may sense whether the card key capable of unlocking the entrance door of the room is inserted into the key tag.

Further, the communicator 110 may receive a signal representing that the guest is scheduled to enter a room. In detail, the communicator 110 may receive a signal representing the state in which the user enters a room where the indoor unit 100 is installed within a short time. The signal representing that the guest is scheduled to enter a room may be a transmission of a signal using a user's personal terminal of the indoor unit 100 or may be the payment completion signal or the reservation confirmation signal received from an external apparatus of the front as illustrated in FIG. 3.

The controller 120 controls each component of the indoor unit. In detail, the controller 120 may control each component of the indoor unit to perform the air conditioning depending on the setting information received by the indoor unit.

Further, the controller 120 may determine whether the received setting information is valid setting information which may be applied to the indoor unit depending on whether the air conditioner is operated as the cooling cycle or the heating cycle.

In detail, the controller 120 may determine whether the received setting information is the valid setting information which may be applied to the indoor unit depending on whether the air conditioner in which the plurality of indoor units are connected to one outdoor unit meets an operation condition of any one of the cooling and heating cycles.

Here, for the air conditioner to prevent different refrigerant cycles from being requested to one outdoor unit depending on the setting of different operation modes in the plurality of indoor units, a dedicated mode may be preset in each of the plurality of indoor units connected to the outdoor unit.

Here, the dedicated mode may include a cooling dedicated mode for the refrigerant cycle of the air conditioner to perform the cooling and a heating dedicated mode for the refrigerant cycle to perform the heating.

Further, the controller 120 may determine whether the received setting information is valid based on the preset dedicated mode. The detailed description thereof will be described below with reference to FIG. 8.

When the outdoor unit is operated as the cooling cycle, if the outdoor unit receives the setting information including the operation mode to be operated as the heating cycle, the controller 120 determines the received setting information as invalid setting information. In detail, when the air conditioner performs the cooling cycle, if the heating cycle receives the setting information set as the required heating operation, the controller 120 may determine the received setting information as the invalid setting information.

In this case, if the indoor unit includes a hot water circulating pump or heat rays, even though the outdoor unit is operated as the cooling cycle, the controller 120 determines the setting information including the operation mode for the outdoor unit to be operated as the heating cycle as the valid setting information. In detail, when the air conditioner performs the cooling cycle, even though the setting information set to perform the heating is received, the controller 120 does not require the heating cycle and may determine the setting information including the heating operation as the valid setting information, for the indoor unit which may perform the heating using the heat rays converting electric energy into heat energy or may perform the heating using hot water supplied through the hot water circulating pump.

Further, when the outdoor unit is operated as the heating cycle, if the outdoor unit receives the setting information including the operation mode to be operated as the cooling cycle, the controller 120 determines the received setting information as the invalid setting information. In detail, when the outdoor unit performs the heating cycle, if the outdoor unit receives the setting information including the operation mode for performing cooling or dehumidification, the controller 120 may determine the received setting information as the invalid setting information.

However, when other indoor units connected to the outdoor unit are not operated, the controller 120 performs a control to perform the air conditioning depending on the received setting information. In detail, if there is no indoor unit which is currently operating, the controller 120 may dominate the outdoor unit which is not occupied and may perform a control to perform the air conditioning depending on the received setting information.

The controller 120 determines whether the received setting temperature is within a predetermined temperature range applicable to the indoor unit based on the operation mode. In detail, the controller 120 may determine whether the indoor unit is within the setting temperature belonging to the predetermined temperature range in which cooling may be performed upon the cooling operation, whether the indoor unit is within the setting temperature belonging to the predetermined temperature range in which heating may be performed upon the heating operation, and whether the indoor unit is within the setting temperature belonging to the predetermined temperature range in which the dehumidification may be performed upon the dehumidification operation.

For example, the temperature of the indoor unit may be previously determined within a range from 18 to 30° C. upon the cooling operation, may be previously determined within a range from 16 to 30° C. upon the heating operation, and may be previously determined within a range from 18 to 30° C. upon the dehumidification operation. Further, if it is determined that the setting temperature set in the corresponding operation mode deviates from the predetermined temperature range as described above, the controller 120 may change the setting temperature to a value belonging to the predetermined temperature range.

The controller 120 may include a central processing unit (CPU), a read only memory (ROM) storing a control program for controlling components of the indoor unit 100, and a random access memory (RAM) storing signals or data input from the outside of the indoor unit 100 or used as a memory region for processes performed by the indoor unit 100. The CPU may include at least one of a single core processor, a dual core processor, a triple core processor, and a quad core processor. The CPU, the ROM, and the RAM may be connected to one another through internal buses.

The indoor unit of the air conditioner according to the exemplary embodiment of the present disclosure may determine whether the setting information is the valid setting information for the indoor unit to perform the air conditioning, thereby performing the correct air conditioning operation.

Meanwhile, the exemplary embodiment of the present disclosure describes a function and an operation of the communicator 110 and the controller 120 which are included in the indoor unit 100, but upon implementation, the communicator 110 and the controller 120 may be included in a separate terminal connected to the indoor unit 100 or may be implemented as a component included in the outdoor unit 200.

Only the simple configuration of the indoor unit 100 is illustrated and described above, but the indoor unit 100 may further include components other than the foregoing components. The more detailed configuration of the indoor unit 100 will be described below with reference to FIG. 5.

Figure 5:
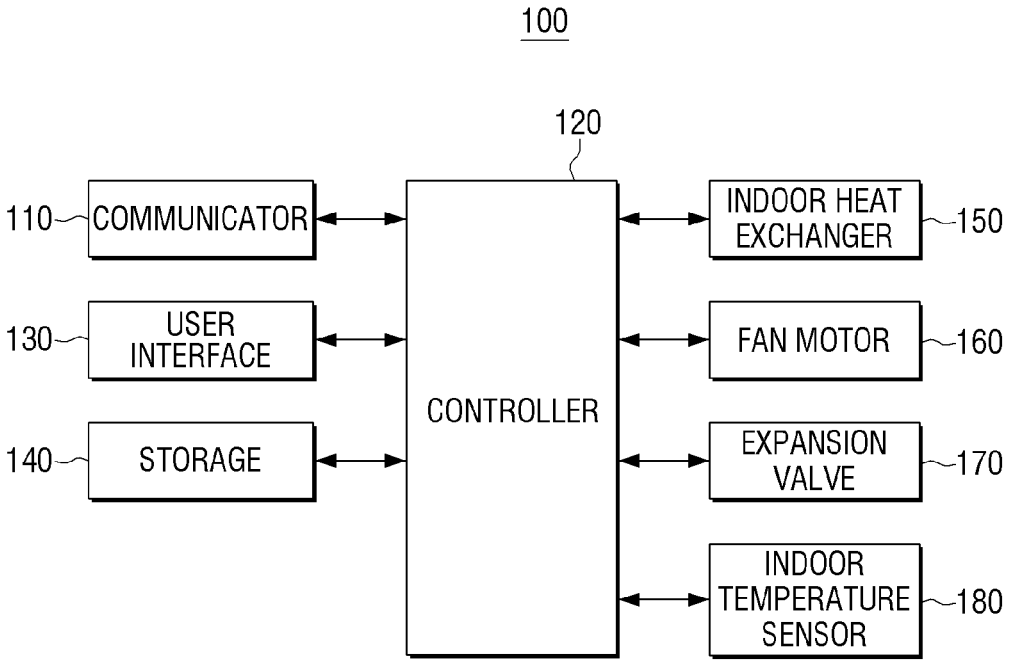
FIG. 5 is a block diagram illustrating a detailed configuration of the indoor unit of FIG. 4.

FIG. 5 is a block diagram illustrating a detailed configuration of the indoor unit of FIG. 4.

Referring to FIG. 5, the indoor unit 100 includes the communicator 110, the controller 120, a user interface 130, a storage 140, an indoor heat exchanger 150, a fan motor 160, an expansion valve 170, and an indoor temperature sensor 180.

The operation of the communicator 110 is described above with reference to FIG. 4, and the description thereof will not be repeatedly described. The user interface 130 may provide an interface which may allow user to set or select various kinds of functions supported by the indoor unit 100. In detail, the user interface 130 may include a button for operating the indoor unit by any one of the cooling operation, the heating operation, the dehumidification operation, the blowing operation, the blowing operation, and the automatic operation. Further, the user interface 130 may include up and down buttons for inputting the setting temperature corresponding to the set operation mode or the discharged wind strength.

Further, the user interface 130 may display various information provided from the indoor unit 100. In detail, the user interface 130 may display the operation mode, the setting temperature, and the air volume set in the indoor unit 100 and may display a currently sensed indoor temperature, a reserved time at which the currently performing air conditioning ends, a reserved time at which the air conditioning starts, etc. The user interface 130 may be implemented as an input/output apparatus such as a touch screen and may be implemented to include a button key performing a pressing input or a display apparatus displaying the state of the air conditioner along with the button key.

The storage 140 stores various programs for performing the function of the air conditioner. For example, the storage 140 may store a user interface program, a notification sound output program, etc. which will be displayed in the indoor unit.

Further, the storage 140 may store the empty room setting information of the air conditioning function for performing air conditioning in a room in the empty room state in which the guest exits from a room. In detail, the storage 140 may store the setting information for air conditioning in an empty room when an event is generated in the empty room state.

The storage 140 may previously store default setting information for air conditioning in the empty room state. Further, the storage 140 may previously store one or a plurality of empty room setting information sets for air conditioning in the empty room state. In this case, the user may select any one of the plurality of pre-stored setting information sets to conveniently perform the empty room setting.

Further, the storage 140 stores setting information for air conditioning in the entering schedule state. In detail, when a new guest is scheduled to enter an empty room in which the indoor unit 100 is installed, the storage 140 may store setting information starting air conditioning of the empty room in which air conditioning is not performed for a while.

The indoor heat exchanger 150 exchanges heat between air introduced into the indoor unit 100 and a refrigerant provided from the outdoor unit. In detail, the indoor heat exchanger 150 may serve as an evaporator upon cooling. That is, the indoor heat exchanger 150 may absorb latent heat required for phase transition at which the refrigerant in a low pressure and low temperature fog state is evaporated into gas from the air introduced into the indoor unit 100. On the contrary, the indoor heat exchanger 150 may serve as a condenser upon heating. That is, when the refrigerant inversely flows to the cooling, the refrigerant heat passing through the indoor heat exchanger 150 may be discharged to the air introduced into the indoor unit 100.

The fan motor 160 provides power for raising the wind. In detail, the fan motor 160 may rotate a fan to discharge the air introduced into the indoor unit to the outside through the indoor heat exchanger 150.

The expansion valve 170 controls the pressure of the refrigerant. In detail, the expansion valve 170 may expand the high pressure and low temperature refrigerant passing through the outdoor heat exchanger upon the cooling to lower the pressure. Further, the expansion valve 170 may also control the amount of refrigerant introduced into the indoor heat exchanger 150. On the contrary, the expansion valve 170 may expand the low pressure and high temperature refrigerant prior to delivering the refrigerant passing through the indoor heat exchanger 150 to the outdoor heat exchanger upon the heating to lower the pressure. Further, the expansion valve 170 may control the amount of refrigerant introduced into the outdoor heat exchanger.

The indoor temperature sensor 180 senses the indoor temperature. In detail, the indoor temperature sensor 180 may use the temperature sensor to sense the temperature of the space in which the indoor unit 100 is installed.

The controller 120 controls each component in the indoor unit 100. In detail, the controller 120 may determine the validity of the setting information provided from the control terminal apparatus 300. The detailed description thereof will be described above with reference to FIG. 4 and the repeated description thereof will be omitted.

Further, the controller 120 may determine the empty room state of the space in which the indoor unit 100 is disposed. Here, the empty room state means that the user is not positioned in the space in which the indoor unit is displaced. If the corresponding space is the room of the hotel, the empty room state means the state in which the card is not inserted into the key tag. Therefore, the controller 120 may receive information on whether or not the card is connected to the key tag from the key tag controller and determine the empty room state based on the received information. Meanwhile, upon implementation, the controller 120 may directly receive the foregoing information from the key tag controller and may also receive the foregoing information through other control apparatuses. Further, upon implementation, in addition to the key tag, information of a printing sensing sensor, a door lock sensor, etc., may also be used.

Meanwhile, the controller 120 may determine that a new guest is scheduled to enter a room. Here, the entering schedule state means the state from a timing when a new guest checks-in an empty room to which a guest is not allocated before the guest enters a room. The controller 120 may determine the entering schedule state based on the signal received from the external apparatus. Here, the external apparatus may be a terminal for payment of accommodation charge which is installed at the front of the hotel or a terminal for confirming a room reservation.

The controller 120 may control the operation of the indoor unit 100 based on the setting information input through the user interface 130. Here, if temperature in a unit different from a unit of the setting temperature supported by the indoor unit is input through the user interface 130, the controller 120 may change the input setting temperature into the temperature corresponding to the unit of the setting temperature supported by the indoor unit. For example, if a temperature of Fahrenheit is input as the setting temperature through the user interface 130, the temperature may be changed to the temperature corresponding to Centigrade supported by the indoor unit in an area using Fahrenheit.

The controller 120 may read the program, etc., stored in the storage 140. In detail, the controller 120 may read programs including a series of readable instructions to perform the air conditioning function.

Meanwhile, when the preset event is generated, the controller 120 may read the stored setting information to control the indoor unit. Here, the preset event may be the generation of the empty room state or the generation of the entering schedule state.

If it is determined that the empty room state is generated, the controller 120 may read the setting information stored in the storage 140 to determine whether the setting information is the valid setting information which may be performed in the indoor unit 100. In detail, if it is sensed that the indoor unit 100 is in the empty room state, the controller 120 may read the setting information stored in the storage 140 for air conditioning of the empty room to determine whether to perform the air conditioning depending on the stored setting information. Therefore, unlike the case in which the controller 120 determines that the immediately input setting information may not be performed when the indoor unit receives the user currently desired setting, the controller 120 may read the stored setting information in the empty room state in which the guest exits a room to determine whether the read empty room setting information is valid.

Further, If the entering schedule state is determined, the controller 120 may read the setting information stored in the storage 140 to determine whether the setting information is the valid setting information which may be performed in the indoor unit. The determination on the validity of the setting information is the same as the foregoing description and therefore the repeated description thereof will be omitted.

The controller 120 may read the setting information corresponding to the preset event from the storage 140 to perform the air conditioning. In detail, the controller 120 may read the setting information for performing the air conditioning in the empty room state or the entering schedule state depending on the event determined from the received signal from the storage 140 to perform the air conditioning depending on the read setting information. Here, the controller 120 may determine the above-mentioned validity on the read setting information and then set the indoor unit 100 to perform the air conditioning only on the option which may be effectively performed.

The controller 120 may sense the pressure and/or the temperature of the refrigerant in the indoor heat exchanger 150 to sense whether the air conditioning is normally performed. For example, the controller 120 may sense whether the pipe of the indoor heat exchanger 150 is damaged or there is frost and whether water generated by condensation of vapor in the air is appropriately removed.

The controller 120 may control a speed of the fan motor 160. In detail, the controller 120 may control a rotating speed of the fan motor 160 depending on the received setting information or the fan speed set by the user.

The controller 120 may control the amount of refrigerant passing through the expansion valve 170. In detail, if the expansion valve 170 is implemented as a motor expansion valve, the controller 120 may control the amount of refrigerant of the expansion valve 170 to control how much the heat is exchanged in the indoor heat exchanger 150.

The controller 120 may perform and enable control of the indoor temperature sensor 180 and receive the indoor temperature sensed by the indoor temperature sensor 180. In detail, the controller 120 may enable the indoor temperature sensor 180 to know the indoor temperature as the feedback information upon cooling and heating and may receive the indoor temperature sensed by the indoor temperature sensor 180. Further, the controller 120 may disable the indoor temperature sensor 180 upon the blowing operation in which the indoor temperature does not need to know.

The indoor unit of the air conditioner according to the exemplary embodiment of the present disclosure as described above may determine whether the setting information is the valid setting information for the indoor unit to perform the air conditioning, thereby performing the correct air conditioning operation.

Figure 6:
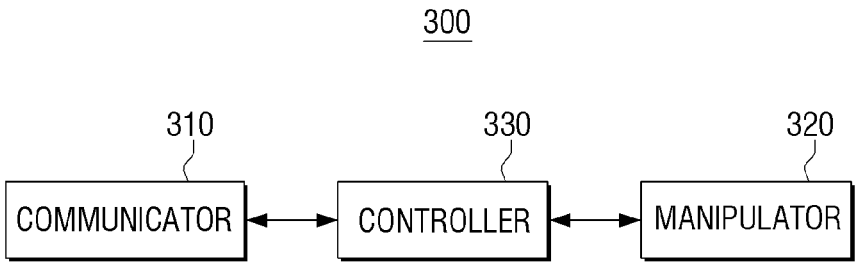
FIG. 6 is a block diagram illustrating a simple configuration of a control terminal apparatus according to an exemplary embodiment of the present disclosure.

FIG. 6 is a block diagram illustrating a simple configuration of the control terminal apparatus according to the exemplary embodiment of the present disclosure.

Referring to FIG. 6, the control terminal apparatus 300 includes a communicator 310, a manipulator 320, and a controller 330.

The communicator 310 receives refrigerant cycle information of the outdoor unit of the air conditioner. In detail, the communicator 310 may receive information on whether the outdoor unit corresponding to the indoor unit receiving the setting information through the manipulator 320 performs any one of the cooling and heating cycles or does not perform the cooling and heating cycles.

Here, the communicator 310 may receive the refrigerant cycle information of the air conditioner from the indoor unit or the outdoor unit of the air conditioner and may receive the refrigerant cycle information of the air conditioner from a separate external terminal apparatus monitoring the air conditioner.

Further, the communicator 310 may receive the information on the dedicated mode set in the air conditioner. In detail, the communicator 310 may receive the information on the dedicated mode when the preset dedicated mode is present in the indoor unit.

Meanwhile, the communicator 310 may receive information on whether a guest checks-in or checks-out a room in accommodations like a hotel.

The communicator 310 transmits information for setting the indoor unit to the indoor unit. In detail, the communicator 310 may determine the validity through the controller 330 and transmit the information for setting the received setting information in the indoor unit depending on the determination result.

Here, the communicator 310 may transmit the operation information of the indoor unit which is determined to rule out the invalid setting from the setting information or to include setting changed to be valid.

The communicator 310 may be formed to perform communication with the air conditioner or the monitoring apparatus through a local area network (LAN) and the Internet network and communication through a universal serial bus (USB) port or a wireless port. Further, the communicator 110 may perform communication depending on standards such as WiFi, Bluetooth, Zigbee, and infrared data association (IrDA) which are a kind of near field communication (NFC), RF like UHF and VHF, and ultra wideband (UWB).

The manipulator 320 receives the setting information on one of the plurality of indoor units in the air conditioner. In detail, the manipulator 320 may provide an interface which may enable the user to set or select various kinds of functions supported by the indoor unit 100. Here, the setting information may be input by a button type pressing input included in the manipulator 320 or may be input by touching the button on the interface displayed on a touch screen provided on the manipulator 320.

For example, the manipulator 320 may include a button for operating the indoor unit by any one of the cooling operation, the heating operation, the blowing operation, the blowing operation, and the automatic operation. Further, the manipulator 320 may include up and down buttons for inputting the setting temperature corresponding to the set operation mode or the discharged wind strength.

The manipulator 320 may receive the state of the indoor unit 100 to be set. In detail, the manipulator 320 may receive the empty room state or the entering schedule state. The user may input setting for air conditioning in the empty room state, the entering schedule state and the general state, respectively.

The controller 330 controls each component of the control terminal apparatus 300. In detail, the controller 330 may control the operations and the functions of the components included in the control terminal apparatus 300 to control any one of the plurality of indoor units of the air conditioner.

The controller 330 may determine whether the setting information input from the manipulator 320 is valid setting information applicable to the indoor unit depending on whether the outdoor unit performs the cooling cycle or the heating cycle.

In detail, the controller 330 may determine whether the received setting information is the valid setting information which may be performed in the indoor unit depending on whether the air conditioner in which the plurality of indoor units are connected to one outdoor unit meets an operation condition of any one of the cooling and heating cycles.

Here, to prevent different refrigerant cycles from being requested to one outdoor unit depending on the setting of different operation modes in the plurality of indoor units, a dedicated mode for the air conditioner may be preset in the control terminal apparatus 300 itself.

Further, the controller 330 may determine whether the received setting information is valid based on the preset dedicated mode. The detailed description thereof will be described below with reference to FIG. 8.

When the outdoor unit is operated as the cooling cycle, if the outdoor unit receives the setting information including the operation mode to be operated as the heating cycle, the controller 330 determines the received setting information as invalid setting information. In detail, when the air conditioner performs the cooling cycle, if the heating cycle receives the setting information set as the required heating operation, the controller 330 may determine the received setting information as the invalid setting information.

In this case, if the indoor unit includes a hot water circulating pump or heat rays, even though the outdoor unit is operated as the cooling cycle, the controller 330 determines the setting information including the operation mode for the outdoor unit to be operated as the heating cycle as the valid setting information.

In detail, when the air conditioner performs the cooling cycle, even though the setting information set to perform the heating is received, the controller 330 does not require the heating cycle and may determine the setting information including the heating operation as the valid setting information, for the indoor unit which may perform the heating using the heat rays converting electric energy into heat energy or may perform the heating using hot water supplied through the hot water circulating pump.

Further, when the outdoor unit is operated as the heating cycle, if the outdoor unit receives the setting information including the operation mode to be operated as the cooling cycle, the controller 330 determines the received setting information as the invalid setting information. In detail, when the air conditioner performs the heating cycle, if the heating cycle receives the setting information set as the cooling operation or the dehumidification operation required by the cooling cycle, the controller 330 may determine the received setting information as the invalid setting information.

Meanwhile, when other indoor units connected to the outdoor unit are not operated, the controller 330 controls the communicator 310 to set the indoor unit according to the received setting information. In detail, if the outdoor unit does not perform the cycle operation to operate other indoor units, the controller 330 may control the communicator 310 to set the indoor unit depending on the input setting information.

The controller 330 determines whether the received setting temperature is within a predetermined temperature range applicable to the indoor unit based on the received operation mode. In detail, when the indoor unit to be set is input with the setting temperature to perform the cooling operation, the controller 330 may determine whether the corresponding indoor unit is the setting temperature belonging to the predetermined temperature range in which the cooling may be performed, when the indoor unit is input with the setting temperature to perform the heating operation, whether the corresponding indoor unit is the setting temperature belonging to the predetermined temperature range in which the heating may be performed, and when the indoor unit is input with the setting temperature to perform the dehumidification operation, whether the corresponding indoor unit is the setting temperature belonging to the predetermined temperature range in which the dehumidification may be performed.

Further, if a value deviating from the temperature range in which the indoor unit may be performed in the input operation mode is input, the controller 330 may change the wrong setting temperature to the temperature range in which the indoor unit may be performed in the corresponding operation mode.

Further, if the temperature in the unit different from the unit of the setting temperature supported by the indoor unit is input through the manipulator 320, the controller 330 may change the input setting temperature to the temperature corresponding to the unit of the setting temperature supported by the indoor unit. For example, if a temperature of Fahrenheit is input as the setting temperature through the manipulator 320, the temperature may be changed to the temperature corresponding to Centigrade supported by the indoor unit in an area using Fahrenheit.

The controller 330 may control the communicator 310 to transmit the operation information of the indoor unit determined depending on the determination result on the validity of the input setting information. In detail, the controller 330 may control the communicator 310 to determine the validity of the input setting information, disregard the invalid setting information, determine the indoor unit to be operated as the setting information automatically validly changed, and transmit the determined operation information of the indoor unit to the indoor unit.

The controller 330 may include a central processing unit (CPU), a read only memory (ROM) storing a control program for controlling components of the control terminal apparatus 300, and a random access memory (RAM) storing signals or data input from the outside of the control terminal apparatus 300 or used as a memory region for processes performed by the control terminal apparatus 300. The CPU may include at least one of a single core processor, a dual core processor, a triple core processor, and a quad core processor. The CPU, the ROM, and the RAM may be connected to one another through internal buses.

As described above, the control terminal apparatus according to the exemplary embodiment of the present disclosure may first determine whether the setting information is the valid setting information for the indoor unit to perform air conditioning to transmit the setting information, thereby allowing the indoor unit to perform the correct air conditioning operation.

Hereinabove, although the exemplary embodiment of the present disclosure describes that the control terminal apparatus performs communication with the indoor unit to control the air conditioning, but upon implementation, the control terminal apparatus may be implemented to communicate with an independent monitoring terminal and an independent control terminal which are connected with the outdoor unit or the indoor unit included in the air conditioner.

Further, the control terminal apparatus may be implemented as a centralized control terminal apparatus capable of controlling a plurality of multi-air conditioners which are installed in a big building with a plurality of rooms like a hotel or a plurality of buildings like a university campus or may be implemented as a mobile terminal apparatus like a remote controller.

Only the simple configuration of the control terminal apparatus 300 is illustrated and described above, but the control terminal apparatus 300 may further include components other than the foregoing components. The more detailed configuration of the indoor unit 100 will be described below with reference to FIG. 7.

Figure 7:
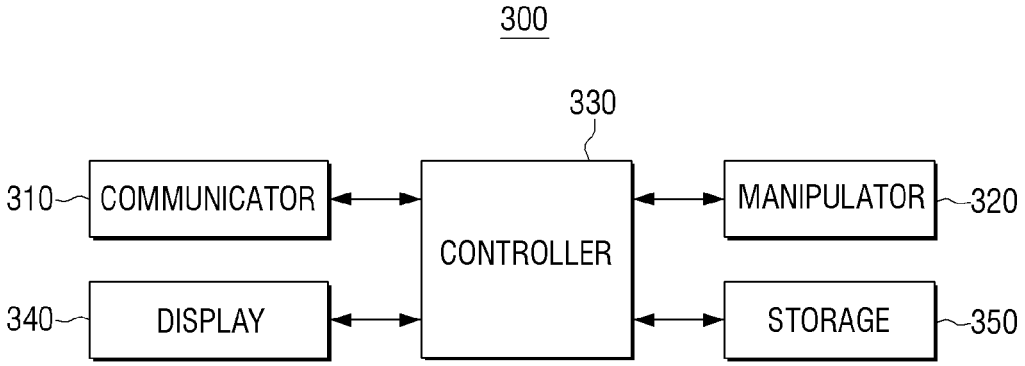
FIG. 7 is a block diagram illustrating a detailed configuration of the control terminal apparatus of FIG. 6.

FIG. 7 is a block diagram illustrating a detailed configuration of the control terminal apparatus of FIG. 6.

Referring to FIG. 7, the control terminal apparatus 300 includes the communicator 310, the manipulator 320, the controller 330, a display 340, and a storage 350.

The communicator 310 receives the refrigerant cycle information of the air conditioner. The detailed description thereof is the same as the communicator 310 of FIG. 6 and therefore will be omitted.

The communicator 310 receives the signal of the key tag controller recognizing whether the card key of the room is inserted. In detail, the communicator 310 may receive the sensed signal from the key tag controller which may sense whether the card key capable of unlocking the entrance door of the room is inserted into the key tag.

The manipulator 320 receives the setting information for setting the indoor unit to perform the air conditioning in a room. The detailed description thereof is the same as the manipulator 320 of FIG. 6 and therefore will be omitted.

The display 340 may display various information provided from the control terminal apparatus 300. In detail, the display 340 may display the operation mode, the setting temperature, and the air volume set in the indoor unit 100 and may display a currently sensed indoor temperature, a reserved time at which the currently performing air conditioning ends, a reserved time at which the air conditioning starts, etc. Further, the plurality of controllable indoor units 100 connected to the outdoor unit 200 may be displayed on the display 340 in a list form. Further, the display 340 may display options which may be set in the indoor unit 100 selected for setting the air conditioning function.

For convenience of explanation, in the control terminal apparatus of FIG. 7, the manipulator 320 and the display 340 are separately configured but upon implementation, the manipulator 320 and the display 340 may be implemented as the input/output apparatus like one touch screen.

The storage 350 stores various programs of the control terminal apparatus for controlling the air conditioner. Further, the storage 350 may store the setting information on at least one of the empty room state in which a guest exits from a room and the entering schedule state in which a new guest is confirmed. In detail, the storage 350 may store the setting information input by the user for air conditioning when the event in the empty room state is generated and/or the setting information input by the user for air conditioning when the event in the entering schedule state is generated.

The storage 350 may be stored with the default setting information for air conditioning for each of the plurality of preset states. Further, the storage 350 may store a plurality of setting information sets in which several options are pre-selected and may store the plurality of setting information sets as the setting information corresponding to the state in which the user inputs the setting information set selected from the plurality of setting information sets.

The controller 330 may determine whether the input setting information is the valid setting information which may be performed by the indoor unit depending on whether the air conditioner performs the cooling cycle or the heating cycle and may control the communicator to set the indoor unit depending on the determination result. The detailed description thereof is the same as the controller 330 of FIG. 6 and therefore will be omitted.

The controller 330 may sense the empty room state depending on the signal of the key tag control which is received by the communicator 310. For example, when the card key is pulled out from the key tag to receive the signal in the off state from the key tag controller, the controller 330 may sense that a guest enters in the empty room state.

The controller 330 may receive the setting information, etc., input through the manipulator 320. Further, the controller 330 may provide the setting information set in the indoor unit 100 and the indoor environment information on the display 340. Further, the controller 330 may create a user interface window to be displayed on the display 340 and provide the created user interface window on the display 340.

The controller 330 may read the program, etc., stored in the storage 350. In detail, the controller 350 may perform a control to read programs including a series of readable instructions to perform the air conditioning function to transmit commands for controlling the air conditioner.

Further, the controller 330 may read the setting information stored in the storage 350 at the preset timing to determine the validity. Here, the preset timing may be a timing when the empty room state is generated.

In detail, if the empty room state is sensed, the controller 330 may read the setting information stored in the storage 350 to determine whether the setting information is the valid setting information which may be performed in the indoor unit.

Further, if it is sensed that the indoor unit 100 to be controlled is in the empty room state, the controller 330 may read the setting information stored in the storage 350 for air conditioning of the empty room to determine whether to perform the air conditioning depending on the stored setting information. Therefore, the controller 330 may immediately determine that the input setting information may not be performed in the indoor unit when the indoor unit receives the user currently desired setting and may also determine whether the stored setting information to be applied in the empty room state in which a guest exits a room is valid.

Meanwhile, if the information that a person resides in the space in which the indoor unit is installed is received through the communicator 310, the controller 330 may enable the empty room operation function of the indoor unit. Further, if the information that a person exits from the space in which the indoor unit is installed is received through the communicator 310, the controller 330 may disenable the empty room operation function of the indoor unit.

For example, in accommodations like a hotel, if the information that a guest checks-in a room in which the indoor unit is installed is received, the controller 330 may automatically enable the empty room operation function of the indoor unit. In this case, for the air conditioning setting upon the empty room depending on the enabled empty room operation function, the controller 330 may read the setting information upon the empty room stored in the storage 140 of the indoor unit 100 or the setting information upon the empty room stored in the storage 350 of the control terminal apparatus 300 and may use the read setting information. Further, the controller 330 may determine whether the empty room setting information for air conditioning in the read empty room is valid.

The control terminal apparatus according to the exemplary embodiment of the present disclosure as described above may determine whether the setting information is the valid setting information for the indoor unit to perform the air conditioning, thereby performing the correct air conditioning operation.

FIG. 8 is a table for describing criteria determining the validity of setting information according to an exemplary embodiment of the present disclosure.

Referring to FIG. 8, when the dedicated mode is cooling or heating, it is arranged in the following Table whether the automatic operation, the cooling operation, the dehumidification operation, the blowing operation, and the heating operation included in the setting information are valid or invalid.

In the cooling dedicated mode in which the refrigerant cycle of the air conditioner is designated as the cooling cycle, the automatic operation automatically performing the air conditioning, the cooling operation and the dehumidification operation requiring the cooling cycle, and the blowing operation which does not require the heat exchange with the refrigerant are valid.

On the other hand, in the cooling dedicated mode, the heating operation requiring the heating cycle is invalid.

In the heating dedicated mode in which the refrigerant cycle of the air conditioner is designated as the heating cycle, the automatic operation automatically performing the air conditioning, the heating operation requiring the heating cycle, and the blowing operation which does not require the heat exchange with the refrigerant are valid.

On the other hand, the cooling operation and the dehumidification operation requiring the cooling cycle in the cooling dedicated mode are invalid.

As described above, it is possible to prevent the operation modes requiring different cycles from being requested to the outdoor unit by determining the validity of the setting information depending on the dedicated mode preset in the indoor unit or the control terminal apparatus.

Figure 9:
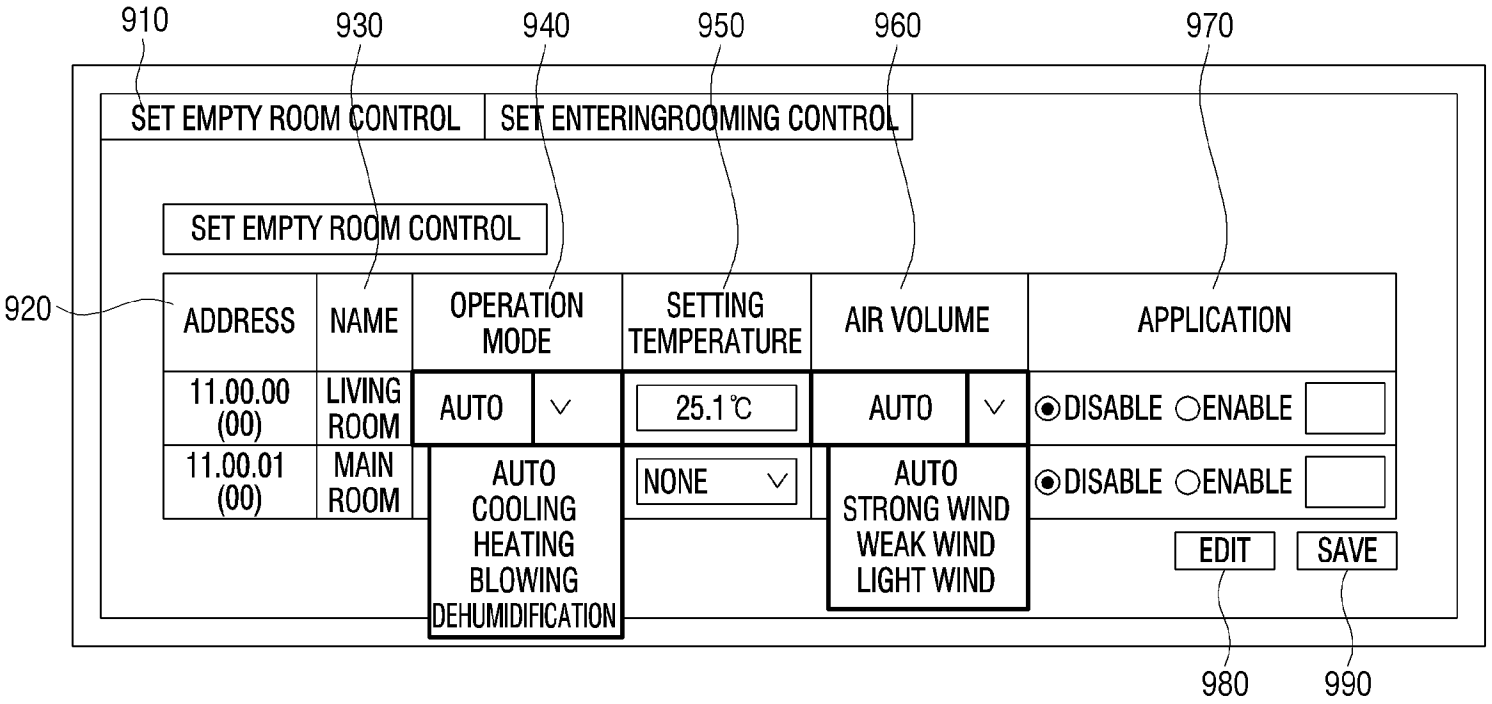
FIG. 9 is a diagram illustrating an example of a user interface for controlling an indoor unit in the control terminal apparatus of FIG. 6.

FIG. 9 is a diagram illustrating the user interface for controlling the indoor unit in the control terminal apparatus of FIG. 6.

Referring to FIG. 9, the user interface for setting an empty room control 910 includes items of an address 920, a name 930, an operation mode 940, a setting temperature 950, an air volume 960, and an application 970.

An address which may access at least one indoor unit connected to a network is displayed in the address 920. For example, an address of 11.00.00 which may access an indoor unit installed in a living room and an IP address of 11.00.01 which may access an indoor unit installed in a main room may be displayed.

A name which may identify at least one indoor unit connected to the network is displayed in the name 930. For example, a name of a room in which an indoor unit is installed, a serial number of indoor units, a model name of an indoor unit, a kind of indoor unit, or a name which is optionally given by a user may be displayed in the name 930.

At least one operation mode option which may be set in the indoor unit is displayed in the operation mode 940. For example, when a down arrow button in the operation mode item is pressed, an option menu is developed at a lower end and the user may select his/her desired operation mode from the option menu.

A text box which may input temperature is displayed in the setting temperature 950. In detail, temperature in a Centigrade, Fahrenheit, and absolute temperature unit may be input to the item of the setting temperature 950.

When a number set at the temperature deviating from the temperature range set to correspond to the selected operation mode is input to the item of the setting temperature 950, the input number may be changed and displayed. For example, when the temperature range which may be set in the operation mode as the cooling operation and the dehumidification operation is previously determined as 18° C. to 30° C., the user selects the cooling operation and when 16° C. is input, the setting temperature may be changed to 18° C. and displayed.

An air volume option which may set the wind strength discharged from the indoor unit is displayed in the air volume 960. For example, when a down arrow button in the air volume item is pressed, the option menu is developed at a lower end and the user may select his/her desired air volume from the option menu. The provided air volume option may include light wind, weak wind, and strong wind depending on an order that the wind strength is weak and may further include an automatic air volume option which automatically controls the wind strength.

An option which enables a function of performing air conditioning using the input empty room control setting when the empty room is sensed in the indoor unit may be displayed in the application 970. For example, when the setting information on the automatic operation, 18° C., and the automatic air volume for the air conditioner in the living room is input and an enable radio button is selected from the application item, the air conditioner in the living room in the empty room state of the living room may perform the air conditioning.

If a disable radio button is selected for an indoor unit installed in an unused room or an indoor unit installed in a corridor or a storehouse, the air conditioning function in the empty room state may be disabled.

Meanwhile, the option of the application item which enables or disables the air conditioning function in the empty room state is linked with a check-in/check-out management system of a hotel, and thus, if information that a guest checks-out a specific room is received, the empty room air conditioning function of the indoor unit installed in the checked-out room is set to be automatically disabled and if the information that a guest checks-in a specific room is received, the empty room air conditioning function of the indoor unit installed in the checked-in room may be set to be automatically enabled.

Further, when the pre-stored setting information set is displayed through the user interface, an editing button 980 may be used by the user to change the item of the setting information.

Further, when air conditioning setting for a new empty room is input or edition of the pre-stored setting information is completed, the storage button 990 may be used to store the setting information set.

Figure 10:
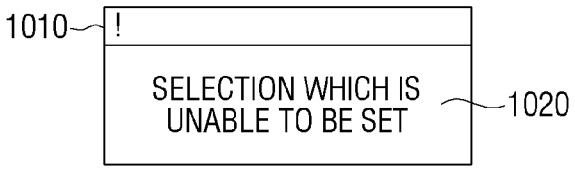
FIG. 10 is a diagram illustrating a message provided from the control terminal apparatus of FIG. 6.

FIG. 10 is a diagram illustrating a message provided from the control terminal apparatus of FIG. 6.

Referring to FIG. 10, a sign representing notification and a text message 1020 are displayed on a user interface window 1010.

If the user inputs the invalid setting information to the control terminal apparatus, the user interface window 1010 may be displayed. Alternatively, when the user selects the invalid operation mode from options of a pull down menu, the user interface window 1010 may be displayed in the user interface of FIG. 9.

The text message 1020 displayed in the user interface window 1010 may be a message which informs the user of the invalid setting information. For example, when the user selects the invalid option in the pull down menu, the user interface window 1010 including the message 1020 called "selection which is unable to be set" may be displayed in a pop up form.

Figure 11:
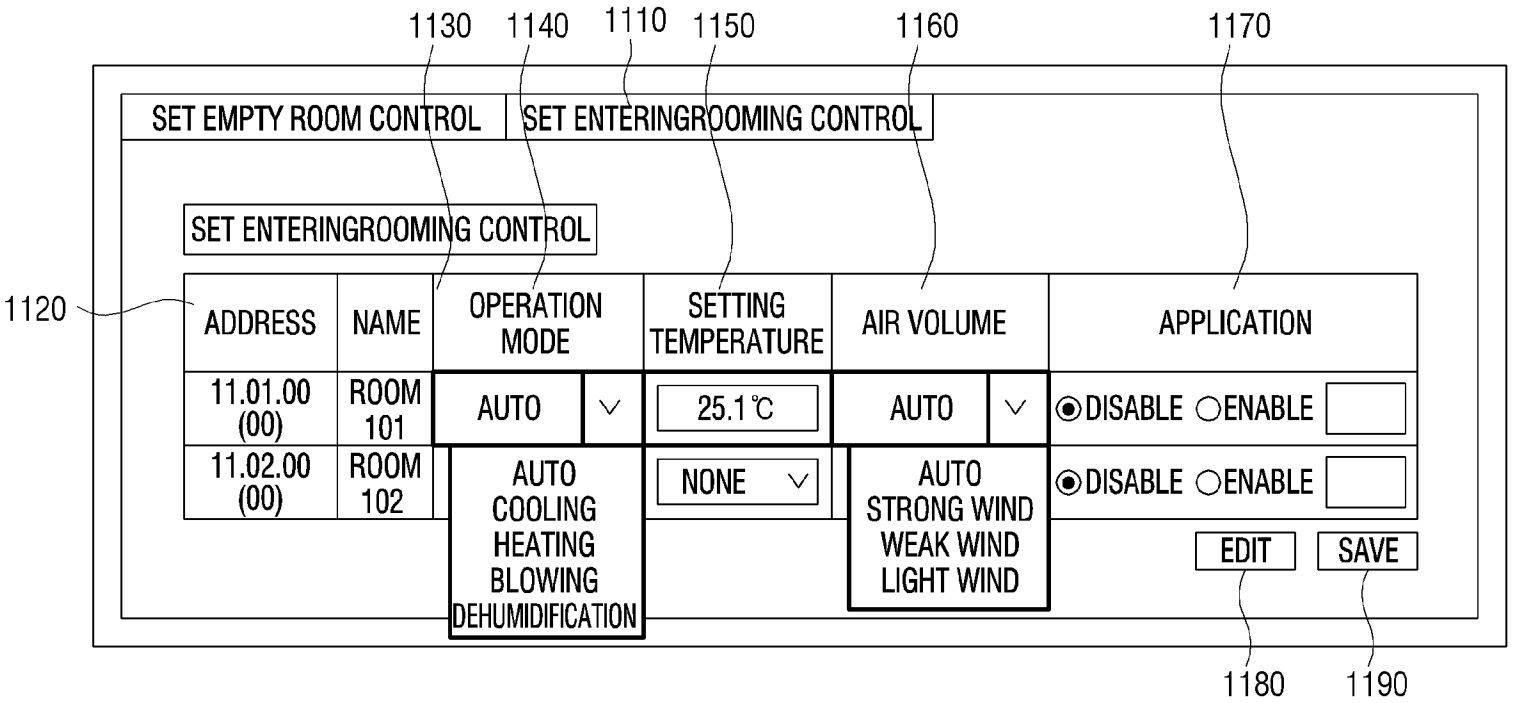
FIG. 11 is a diagram illustrating another example of a user interface for controlling an indoor unit in the control terminal apparatus of FIG. 6.

FIG. 11 is a diagram illustrating another example of a user interface for controlling an indoor unit in the control terminal apparatus of FIG. 6.

Referring to FIG. 11, the user interface for setting the entering control setting 1110 includes items of an address 1120, a name 1130, an operation mode 1140, a setting temperature 1150, an air volume 1160, and an application 1170. Here, the user interface for the entering control setting 1110 may be a screen on which the entering control setting 1110 area of an upper end in the user interface for the empty room control setting 910 of FIG. 9 is selected and switched.

An address which may access at least one indoor unit connected to a network is displayed in the address 1120. For example, an address of 11.01.00 which may access an indoor unit installed in room 101 and an IP address of 11.02.00 which may access an indoor unit installed in room 102 may be displayed.

A name which may identify at least one indoor unit connected to the network is displayed in the name 1130. For example, at least one of a number of a room in which an indoor unit is installed, a serial number of indoor units, a model name of an indoor unit, a kind of indoor unit, or a name which is optionally given by a user may be displayed in the name 1130.

At least one operation mode option which may be set in the indoor unit is displayed in the operation mode 1140. For example, when a down arrow button is pressed, the operation mode item is configured of a scroll down menu in which an option menu is developed and the user may select his/her desired operation mode from the options listed in the developed menu.

A text box which may input temperature is displayed in the setting temperature 1150. In detail, temperature in a Centigrade, Fahrenheit, and absolute temperature unit may be input to the item of the setting temperature 1150.

When a number set at the temperature deviating from the temperature range set to correspond to the selected operation mode is input to the item of the setting temperature 1150, the input number may be changed and displayed. For example, when the temperature range which may be set in the operation mode as the cooling operation and the dehumidification operation is previously determined as 18° C. to 30° C., the user selects the cooling operation and when 16° C. is input, the setting temperature may be changed to 18° C. and displayed.

In connection with the setting temperature 1150, in addition to a scheme of directly inputting a number, a scheme of display a button increasing or decreasing the displayed number and a scheme of selecting, by a user, a button to change the temperature may be used.

An air volume option which may set the wind strength discharged from the indoor unit is displayed in the air volume 1160. For example, the air volume item may be implemented as a scroll down menu in which the option menu is developed at a lower end by pressing the down arrow button. Further, the user may select his/her desired air volume from options listed in the developed menu. The provided air volume option may include light wind, weak wind, and strong wind depending on an order that the wind strength is weak and may further include an automatic air volume option which automatically controls the wind strength.

If the entering schedule state in which a guest checks-in a room corresponding to the address 1120 and the name 1130 is sensed, an option to enable a function of performing air conditioning according to the entering control settings input on the row of the user interface is displayed in the application 1170.

For example, when the setting information of cooling, 18° C., and strong wind is input to the air conditioner installed in room 101 and the enable radio button is selected from the application item, the air conditioning function in the entering schedule state into room 101 is enabled. Next, when the entering schedule state is sensed, the air conditioner of room 101 may perform the air conditioning based on the cooling operation of 18° C. using strong wind.

If the use of the specific room is stopped due to construction or repair or in the case of weather or season in which the entering control is not required, a manager may select the disable radio button to disable the air conditioning function in the entering schedule state.

Meanwhile, the option of the application 1170 item which enables or disables the air conditioning function in the entering schedule state is linked with the check-in/check-out management system of a hotel, and thus, if information that a guest checks-out a specific room is received, the entering control function of the indoor unit installed in the checked-out room is set to be automatically disabled and if the information that a guest checks-in a specific room is received, the entering control function of the indoor unit installed in the checked-in room may be set to be automatically enabled.

Further, when the pre-stored setting information set is displayed through the user interface, an editing button 1180 may be used by the user to change the item of the setting information.

Further, when air conditioning setting for a new empty room is input or edition of the pre-stored setting information is completed, the storage button 1190 may be used to store the setting information set.

Figure 12:
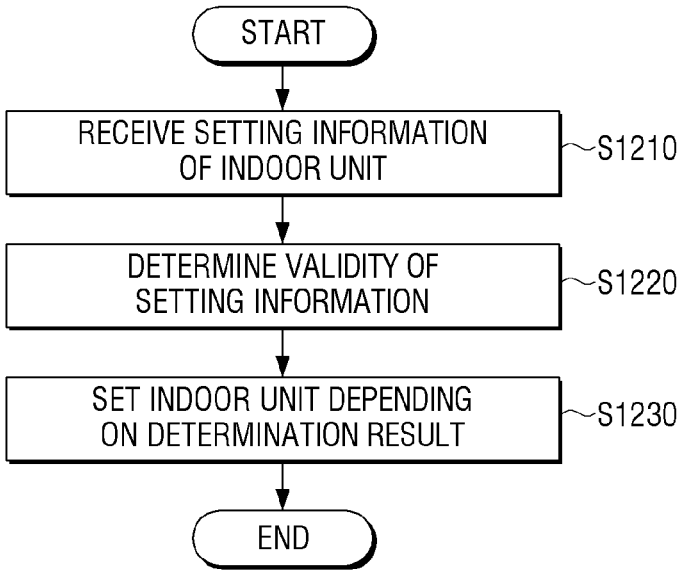
FIG. 12 is a flow chart for describing an air conditioning method of an indoor unit according to an exemplary embodiment of the present disclosure.

FIG. 12 is a flow chart for describing an air conditioning method of an indoor unit according to an exemplary embodiment of the present disclosure.

Referring to FIG. 12, the air conditioning method of the indoor unit of the air conditioner performing the cooling cycle or the heating cycle by connecting between the outdoor unit and the plurality of indoor units first receives the setting information of the indoor unit (S1210). In detail, the indoor unit may receive the setting information for performing the air conditioning in a room from the control terminal apparatus. As another example, the indoor unit may receive the setting information by the user's manipulation from the manipulation input unit which may be provided in the indoor unit to input the setting information or may receive the setting information from the external apparatus for controlling the indoor unit.

Next, the validity of the received setting information is determined (S1220). In detail, it may be determined whether the received setting information is the valid setting information applicable to the indoor unit depending on whether the air conditioner is operated as the cooling cycle or the heating cycle. Here, the validity of the setting information may be determined based on the dedicated mode preset in each indoor unit so that the same cycle is performed in the outdoor unit of the air conditioner.

In more detail, when the outdoor unit is operated as the cooling cycle, if the setting information including the operation mode in which the outdoor unit needs to be operated as the heating cycle is received, the received setting information may be determined as the invalid setting information and when the outdoor unit is operated as the heating cycle, if the setting information including the operation mode in which the outdoor unit needs to be operated as the cooling cycle is received, the received setting information may be determined as the invalid setting information.

In this case, if the indoor unit includes a hot water circulating pump or heat rays, even though the outdoor unit is operated as the cooling cycle, the setting information including the operation mode for the outdoor unit to be operated as the heating cycle may be determined as the valid setting information.

If other indoor units connected to the outdoor unit are not operated, the air conditioning depending on the received setting information may be performed. In detail, if the air conditioner does not perform both of the cooling cycle and the heating cycle, the air conditioning method proceeds to a step of controlling the indoor unit to perform the air conditioning depending on the received setting information without performing the process of determining the validity of the received setting information. That is, the first operated indoor unit preoccupies the cycle of the outdoor unit in the state in which any of the plurality of indoor units does not perform the air conditioning, thereby performing the air conditioning depending on the received setting information.

Meanwhile, the setting information received in the indoor unit may include at least one of the operation mode for performing, by the indoor unit, the air conditioning based on any one of the cooling operation, the heating operation, the dehumidification operation, and the blowing operation, the setting temperature setting the user's desired indoor temperature and the air volume setting the wind strength discharged from the indoor unit and the indoor unit may determine whether the received setting temperature is within the predetermined temperature range applicable to the indoor unit depending on the validly set operation mode.

Next, the operation of the indoor unit is determined (S1230) depending on the result of the validity of the setting information determined in S1220. In detail, the setting information may be set in the indoor unit depending on the determination result on whether the setting information is the valid setting information.

In more detail, if it is determined that the setting information for setting the indoor unit to be operated as the cooling operation is invalid, the indoor unit may reject the air conditioning performance depending on the received setting information. Further, a step of issuing, by the indoor unit, a beef sound for informing the user of the determination result that the setting information is the invalid setting information or displaying a message that the input option is invalid to set up on the display apparatus may be further performed.

As described above, the air conditioning method of the indoor unit of the air conditioner according to the exemplary embodiment of the present disclosure may determine whether the setting information is the valid setting information for the indoor unit to perform the air conditioning, thereby performing the correct air conditioning operation.

Meanwhile, the air conditioning method above describes a step of determining the validity of the input setting information, but may further include receiving a signal representing the generation of the preset event and performing the air conditioning in response thereto.

In detail, the air conditioning method as described above may further include receiving the signal representing the generation of the empty room state and performing the air conditioning for the empty room control in response to the received signal. In this case, the indoor unit may additionally perform the procedure of determining the validity of the setting information on the read empty room state.

Further, the air conditioning method as described above may further include receiving the signal representing the generation of the entering schedule state and performing the air conditioning for the entering control in response to the received signal. Even in this case, the indoor unit may additionally perform the procedure of determining the validity of the setting information on the read entering schedule state.

Further, the air conditioning method according to the exemplary embodiment of the present disclosure may be implemented in the indoor unit of FIG. 4 or 5. Further, the temperature control method may also be implemented by program codes stored in various types of recording media and executed by a CPU, or the like.

In detail, the codes for performing the above-mentioned methods may be stored in various types of recording media that is readable by a terminal, such as a random access memory (RAM), a flash memory, a read only memory (ROM), an erasable programmable ROM (EPROM), an electronically erasable and programmable ROM (EEPROM), a register, a hard disk, a removable disk, a memory card, a universal serial bus (USB) memory, a compact-disk (CD) ROM, and the like.

Figure 13:
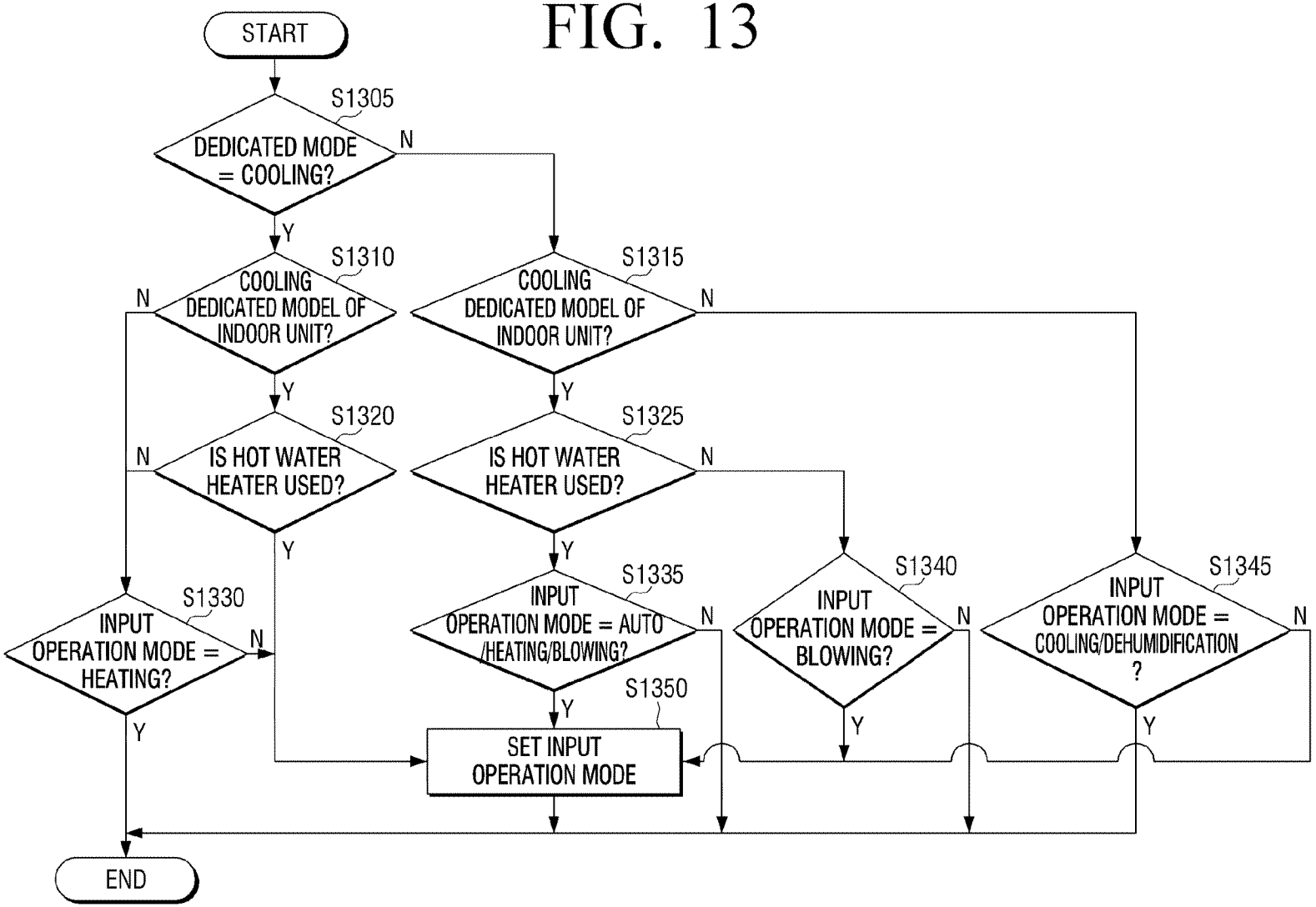
FIG. 13 is a flow chart for describing a procedure for determining validity of an operation mode according to an exemplary embodiment of the present disclosure.

FIG. 13 is a flow chart for describing a procedure for determining validity of an operation mode according to an exemplary embodiment of the present disclosure.

FIG. 13 illustrates a procedure of determining the validity of the operation mode based on the indoor unit or the control terminal apparatus in which the dedicated mode is set.

Referring to FIG. 13, first, it is determined whether the dedicated mode is the cooling dedicated mode (S1305). In detail, for the air conditioner in the indoor unit to perform only the cooling cycle, it may be determined whether the preset dedicated mode is used only for the cooling.

If it is determined that the dedicated mode is the cooling dedicated mode (S1305, Y), it is determined whether the indoor unit to be set is a cooling dedicated (CO) model (S1310).

When the indoor unit is the cooling dedicated model which may perform only the air conditioning by the cooling cycle (S1310, Y), it is determined whether the indoor unit performs the heating using a hot water heater (S1320). This step may be substituted into a step of determining whether the indoor unit uses heat rays to perform the heating or followed the step of determining whether the indoor unit uses heat rays to perform the heating.

If the indoor unit is a model in which the heating is performed using the hot water heater (S1320, Y), all the operation modes of the cooling and the heating may be performed and therefore the indoor unit is set depending on the input operation mode (S1350).

Meanwhile, if the indoor unit is not the cooling dedicated model (S1310, N), the indoor unit is a heat pump model in which the cooling and heating by the refrigerant may be performed and it is determined whether the input operation mode is the heating operation (S1330).

Further, if the input operation mode is determined as the heating operation (S1330, Y), the setting depending on the operation mode input as conflicting with the cooling dedicated mode is rejected.

On the other hand, if the input operation mode is any one of auto/cooling/dehumidification/blowing operations, not the heating operation (S1330, N), the input operation mode is the valid setting, and thus the indoor unit is set depending on the input operation mode (S1350).

Meanwhile, if the preset dedicated mode is the heating, not the cooling (S1305, N), it is determined whether the indoor unit for setting the operation mode is the cooling dedicated model (S1315).

If the indoor unit is the cooling dedicated model (S1315, Y), it is determined whether the indoor unit uses the hot water heater to perform the heating (S1325).

If the indoor unit uses the hot water heater as the cooling dedicated model to perform the cooling and heating (S1325, Y), it is determined whether the operation mode which is not disposed in the heating dedicated mode is input. That is, it is determined whether the input operation mode is the automatic operation, the heating operation, or the blowing operation (S1335).

If the input operation mode is the automatic operation, the heating operation, or the blowing operation which may be set even in the heating dedicated mode (S1335, Y), the indoor unit is set as the input operation mode (S1350).

If the input operation mode is the cooling operation or the dehumidification operation which may not be set in the heating dedicated mode (S1335, N), the setting of the input operation mode is rejected.

Meanwhile, if the indoor unit is the cooling dedicated model and may not perform the heating using the hot water heater (S1325, N), it is determined only whether the input operation mode is the blowing operation (S1340) and if the input operation mode is the blowing operation (S1340, Y), the indoor unit is set as the input operation mode (S1350). However, if the input operation mode is not the blowing operation (S1340, N), the cooling operation and the dehumidification operation by the heating dedicated mode may not be set. Further, the indoor unit is the cooling dedicated model and therefore may not also perform the heating, such that the setting of the indoor unit depending on the input operation mode may be rejected.

Meanwhile, if the indoor unit is not the cooling dedicated model but the heat pump model in the heating dedicated mode (S1315, N), it is determined whether the input operation mode is the cooling operation or the dehumidification operation (S1345) and if the cooling operation or the dehumidification operation which may not be set in the heating dedicated mode is input (S1345, Y), the setting of the indoor unit depending on the input operation mode is rejected. On the other hand, if the input operation mode is not the cooling operation or the dehumidification operation but the automatic operation, the cooling operation, or the blowing operation (S1345, N), the input operation mode is the valid operation mode, the indoor unit is set as the input operation mode (S1350).

The procedure of determining the validity of the operation mode according to the exemplary embodiment of the present disclosure may bring about the setting of the correct operation mode in the multi-air conditioner in which the plurality of indoor units are connected to the outdoor unit and different kinds of indoor unit models may be connected to the outdoor unit.

Meanwhile, the method for determining the validity of the operation mode according to the exemplary embodiment of the present disclosure may be implemented in the indoor unit of FIG. 4 or 5 or may be implemented in the control terminal apparatus of FIG. 6 or 7. Further, the method for determining the validity may also be implemented by program codes stored in various types of recording media and executed by a CPU, or the like.

Figure 14:
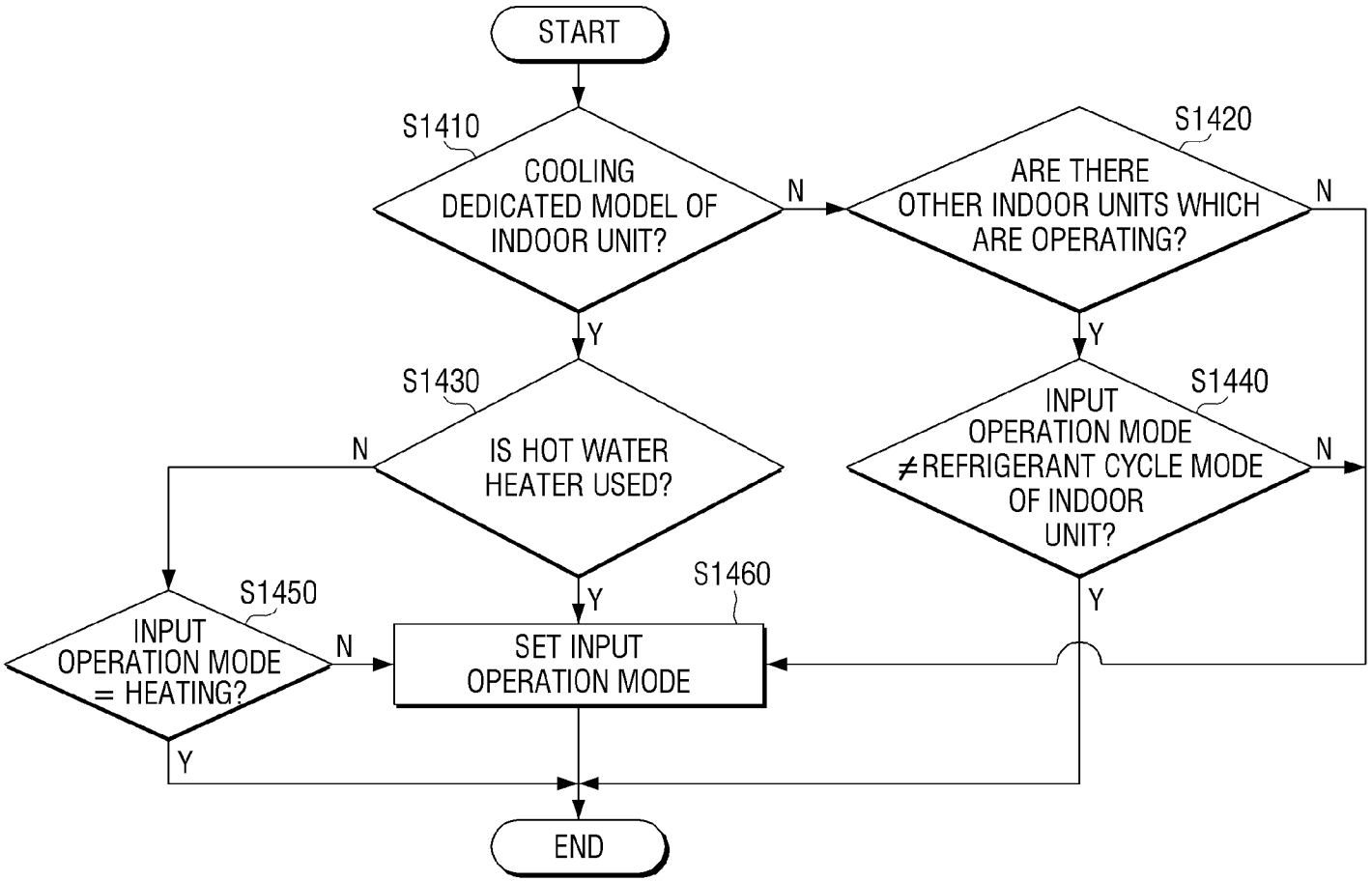
FIG. 14 is a flow chart for describing a procedure for determining validity of an operation mode according to another exemplary embodiment of the present disclosure.

FIG. 14 is a flow chart for describing a procedure for determining validity of an operation mode according to another exemplary embodiment of the present disclosure.

FIG. 14 illustrates a procedure of determining the validity of the operation mode based on the indoor unit or the control terminal apparatus in which the dedicated mode is not set.

Referring to FIG. 14, first, it is determined whether the indoor unit is the cooling dedicated model (S1410).

Further, if the indoor unit is the cooling dedicated model which may perform only the cooling cycle (S1410, Y), the indoor unit uses the hot water heater to determine whether the heating is performed (S1430).

If the indoor unit which is the cooling dedicated model performs the cooling and uses the hot water heater to perform the independent heating independent of the refrigerant cycle (1230, Y), the indoor unit is set as the input operation mode (S1460).

If the indoor unit which is the cooling dedicated model does not perform the heating by the hot water heater (S1430, N), it is determined whether the input operation mode is the heating operation (S1450).

If the input operation mode which is the heating operation is the operation mode which may not be performed in the cooling dedicated model (S1450, Y), the setting by the input operation mode is rejected.

On the other hand, if the input operation mode is not the heating operation but the cooling, dehumidification, or blowing operation (S1450, N), the indoor unit is set as the input operation mode (S1460).

Meanwhile, if the indoor unit to be set is not the cooling dedicated model but the heat pump model (S1410, N), it is determined whether there is other indoor units which are operating (S1420). In detail, it is determined whether the air conditioning is performed in other indoor units which are connected to the outdoor unit to which the indoor unit to be set is connected.

If other indoor units which are operating are present (S1420, Y), it is determined whether the refrigerant cycle by the input operation mode mismatches the refrigerant cycle mode by other indoor units which are operating (S1440). For example, if the refrigerant cycle of the outdoor unit preoccupied by other indoor units is the cooling cycle, the input operation mode mismatches the operation mode of the heating operation requiring the heating cycle.

If the required refrigerant cycle depending on the input operation mode mismatches the refrigerant cycle preoccupied by other indoor units (S1440, Y), the setting of the indoor unit depending on the input operation mode is rejected.

On the other hand, if the required refrigerant cycle depending on the input operation mode matches the refrigerant cycle preoccupied by other indoor units or the blowing operation which does not require the refrigerant cycle (S1440, N), the input operation mode is the valid operation mode and therefore the indoor is set as the input operation mode (S1460).

Meanwhile, if the indoor unit is the heat pump model in which the cooling and heating may be performed and there are no other indoor units which are operating (S1420, N), there are no conditions which will be considered in the determination on the validity of the input operation mode, and therefore the indoor unit is set as the input operation mode (S1460).

The procedure of determining the validity of the operation mode according to another exemplary embodiment of the present disclosure may bring about the setting of the correct operation mode in the multi-air conditioner in which the plurality of indoor units are connected to the outdoor unit and different kinds of indoor unit models may be connected to the outdoor unit.

Meanwhile, the method for determining the validity of the operation mode according to the exemplary embodiment of the present disclosure may be implemented in the indoor unit of FIG. 4 or 5 or may be implemented in the control terminal apparatus of FIG. 6 or 7. Further, the method for determining the validity may also be implemented by program codes stored in various types of recording media and executed by a CPU, or the like.

Figure 15:
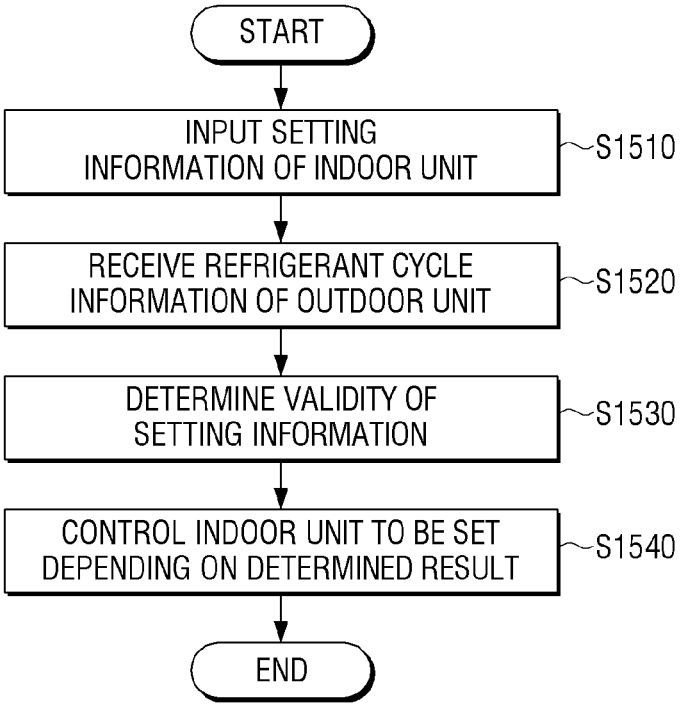
FIG. 15 is a flow chart for describing a method of controlling a control terminal apparatus according to an exemplary embodiment of the present disclosure.

FIG. 15 is a flow chart for describing a method of controlling a control terminal apparatus according to an exemplary embodiment of the present disclosure.

Referring to FIG. 15, the control method of the control terminal apparatus first receives the setting information of the indoor unit (S1510). In detail, the control terminal apparatus may receive the setting information for performing the air conditioning on one indoor unit which will be set by the user among the plurality of indoor units.

Next, the refrigerant cycle information of the outdoor unit is received (S1520). In detail, the control terminal apparatus may communicate with a means for setting the operation of the air conditioner or a means for sensing the direction of the refrigerant cycle to determine whether to perform the cooling cycle and the heating cycle or receive the refrigerant cycle information that the refrigerant is not used.

Next, the validity of the input setting information is determined (S1530). In detail, it may be determined whether the indoor unit performs the air conditioning operation based on the input setting information.

Here, the validity of the setting information may be determined based on the received refrigerant cycle information. Further, the validity of the input setting information may be determined based on the information on the dedicated mode preset in the control terminal apparatus or the dedicated mode preset in the air conditioner received from the air conditioner.

Next, a control to set the indoor unit depending on the determination result on the validity of the input setting information is performed (S1540). In detail, the control terminal apparatus transmits the setting information determined to be valid to the indoor unit to set the indoor unit to perform the air conditioning depending on the input setting information. Alternatively, the control terminal apparatus may perform a control to change the invalid setting information to the valid setting information and transmit the valid setting information to the indoor unit or reject the setting of the indoor unit depending on the invalid setting information.

The control method of the control terminal apparatus according to the exemplary embodiment of the present disclosure as described above may determine whether the setting information is the valid setting information for the indoor unit to perform the air conditioning, thereby performing the correct air conditioning operation.

Further, the control method according to the exemplary embodiment of the present disclosure may be implemented in the control terminal apparatus of FIG. 6 or 7. Further, the control method may also be implemented by program codes stored in various types of recording media and executed by a CPU, or the like.

In detail, the codes for performing the above-mentioned methods may be stored in various types of recording media that is readable by a terminal, such as a random access memory (RAM), a flash memory, a read only memory (ROM), an erasable programmable ROM (EPROM), an electronically erasable programmable ROM (EEPROM), a register, a hard disk, a removable disk, a memory card, a universal serial bus (USB) memory, a compact-disk (CD) ROM, and the like.

According to the exemplary embodiments of the present disclosure, it is possible to set the air conditioning function which is valid for the multi-air conditioner system performing the air conditioning in several places and meets the user's intention by using the plurality of indoor units commonly using one outdoor unit.

Further, it is possible for the host to provide the pleasant rooming environment to guests in accommodations with a plurality of rooms.

Meanwhile, although the case in which all the components configuring an exemplary embodiment of the present disclosure are combined with each other as one component or are combined and operated with each other has been described, the present disclosure is not necessarily limited thereto. That is, all the components may be operated, being optionally coupled with one or more within the scope of the present disclosure. In addition, although each of all the components may be implemented by one independent hardware, some or all of the respective components which are selectively combined with each other may be implemented by a computer program having a program module performing some or all of functions combined with each other in one or plural hardware.

Codes and code segments configuring the computer program may be easily inferred by those skilled in the art to which the present disclosure pertains. The computer program is stored in non-transitory computer readable media and is read and executed by a computer, thereby making it possible to implement an exemplary embodiment of the present disclosure.

Here, the non-transitory computer readable medium is not a medium that stores data therein for a while, such as a register, a cache, a memory, or the like, but means a medium that semi-permanently stores data therein and is readable by a device. In detail, the programs described above may be stored and provided in the non-transitory computer readable medium such as a CD, a digital versatile disk (DVD), a hard disk, a Blu-ray disk, a USB, a memory card, a ROM, or the like.

Although exemplary embodiments of the present disclosure have been illustrated and described, the present disclosure is not limited to the above-mentioned specific exemplary embodiment, but may be variously modified by those skilled in the art to which the present disclosure pertains without departing from the spirit and scope of the present disclosure as claimed in the claims. In addition, such modifications should also be understood to fall within the scope of the present disclosure.

What is claimed is:

1. An air conditioner including a plurality of indoor units and an outdoor unit connected to the plurality of indoor units, the air conditioner comprising:

a communicator configured to receive setting information for at least one indoor unit from among the plurality of indoor units, to perform air conditioning; and a controller configured to:

determine a validity of the received setting information based on an operation mode of the outdoor unit, and based on the received setting information being determined as valid setting information, perform the air conditioning through the indoor unit according to the received setting information, wherein the controller is configured to:

based on first setting information comprising a command for controlling the indoor unit to operate in a heating mode being received while the outdoor unit is operating in a cooling mode, determine the first received setting information as invalid setting information, and based on second setting information comprising a command for controlling the indoor unit to operate in the cooling mode being received while the outdoor unit is operating in the heating mode, determine the second received setting information as invalid setting information, wherein if the indoor unit comprises at least one of a hot water circulating pump and heat rays, the controller is configured to determine the first received setting information received while the outdoor unit is operating in the cooling mode as the valid setting information.

2. The air conditioner as claimed in claim 1, wherein the controller performs the air conditioning depending on the received setting information, if other indoor units of the plurality of indoor units connected to the outdoor unit are not being operated.

3. The air conditioner as claimed in claim 1, wherein the setting information includes an operation mode for the indoor unit to perform the air conditioning by any one of a cooling operation, a heating operation, a dehumidification operation, and a blowing operation, a setting temperature for setting user's desired indoor temperature, and an air volume for setting wind strength discharged from the indoor unit, and the controller determines whether the received setting temperature is within a predetermined temperature range applicable to the indoor unit based on the operation mode.

4. The air conditioner as claimed in of claim 1, further comprising:

a storage to store the set setting information, wherein the controller controls performance of the air conditioning in an empty room state depending on the stored setting information in response to a signal, from a key tag sensor in a room in which the indoor unit is installed, representing that a card key is not sensed by the key tag sensor.

5. The air conditioner as claimed in claim 1, further comprising:

a storage storing the set setting information, wherein the controller performs a control to perform the air conditioning according to the stored setting information, in response to a signal about payment completion or a reservation confirmation received from an external apparatus.

6. A control terminal apparatus configured to control a plurality of indoor units, respectively, in an air conditioner including the plurality of indoor units and an outdoor unit connected to the plurality of indoor units, the control terminal apparatus comprising:

a manipulator configured to receive setting information for one indoor unit of the plurality of indoor units;

a communicator configured to receive refrigerant cycle information of the outdoor unit corresponding to the indoor unit receiving the setting information; and a controller configured to:

determine a validity of the received setting information based on an operation mode of the outdoor unit and perform air conditioning through the indoor unit according to the received setting information when the received setting information is determined as valid setting information, wherein the controller is configured to:

based on first setting information comprising a command for controlling the indoor unit to operate in a heating mode being received while the outdoor unit is operating in a cooling mode, determine the first received setting information as invalid setting information, and based on second setting information comprising a command for controlling the indoor unit to operate in the cooling mode being received while the outdoor unit is operating in the heating mode, determine the second received setting information as invalid setting information, wherein if the indoor unit comprises at least one of a hot water circulating pump and heat rays, the controller is configured to determine the first received setting information received while the outdoor unit is operating in the cooling mode as the valid setting information.

7. The control terminal apparatus as claimed in claim 6, wherein the controller controls the communicator to set the indoor unit depending on the received setting information, if other indoor units of the plurality of outdoor units connected to the outdoor unit are not being operated.

8. The control terminal apparatus as claimed in claim 6, wherein the setting information includes an operation mode for the indoor unit to perform the air conditioning by any one of a cooling operation, a heating operation, a dehumidification operation, and a blowing operation, a setting temperature for setting user's desired indoor temperature, and an air volume for setting wind strength discharged from the indoor unit, and the controller determines whether the received setting temperature is within a predetermined temperature range applicable to the indoor unit based on the operation mode.

9. An air conditioning method of an indoor unit of an air conditioner including a plurality of indoor units and an outdoor unit connected to the plurality of indoor units, the air conditioning method comprising:

receiving setting information for at least one indoor unit from among the plurality of indoor units, to perform air conditioning;

determining a validity of the received setting information based on an operation mode of the outdoor unit;

performing the air conditioning through the indoor unit according to the received setting information when the received setting information is determined as valid setting information, based on first setting information comprising a command for controlling the indoor unit to operate in a heating mode being received while the outdoor unit is operating in a cooling mode, determining the first received setting information as invalid setting information, and based on second setting information comprising a command for controlling the indoor unit to operate in the cooling mode being received while the outdoor unit is operating in the heating mode, determining the second received setting information as invalid setting information, wherein if the indoor unit comprises at least one of a hot water circulating pump and heat rays, determining the first received setting information received while the outdoor unit is operating in the cooling mode as the valid setting information.

10. The air conditioning method as claimed in claim 9, further comprising:

performing the air conditioning depending on the received setting information, if other indoor units connected to the outdoor unit are not being operated.

11. The air conditioning method as claimed in claim 9, wherein the setting information includes an operation mode for the indoor unit to perform the air conditioning by any one of a cooling operation, a heating operation, a dehumidification operation, and a blowing operation, a setting temperature for setting user's desired indoor temperature, and an air volume for setting wind strength discharged from the indoor unit, and in the determining, it is determined whether the received setting temperature is within a predetermined temperature range applicable to the indoor unit based on the operation mode.

12. The air conditioning method as claimed in claim 9, further comprising:

storing the set setting information; and performing a control to perform the air conditioning in an empty room state depending on the stored setting information in response to a signal, from a key tag sensor in a room in which the indoor unit is installed, representing that a card key is not sensed by the key tag sensor.

13. The air conditioning method as claimed in claim 9, further comprising:

storing the set setting information; and performing a control to perform the air conditioning according to the stored setting information, in response to a signal about payment completion or reservation confirmation received from an external apparatus.

14. A non-transitory computer readable recording media including at least one program to implement the air conditioning method of claim 9.

15. A controller configured to control an air conditioner including a plurality of indoor units and an outdoor unit connected to the plurality of indoor units, the controller comprising:

a manipulator; and at least one hardware processor configured to:

receive setting information through the manipulator for performing air conditioning of a room using at least one indoor unit of the plurality of indoor units, determine a validity of the received setting information based on an operation mode of the outdoor unit, and control the indoor unit to perform air conditioning of the room through the indoor unit according to the received setting information when the received setting information is determined as valid setting information, wherein the at least one hardware processor is configured to:

based on first setting information comprising a command for controlling the indoor unit to operate in a heating mode being received while the outdoor unit is operating in a cooling mode, determine the first received setting information as invalid setting information, and based on second setting information comprising a command for controlling the indoor unit to operate in the cooling mode being received while the outdoor unit is operating in the heating mode, determine the second received setting information as invalid setting information, wherein if the indoor unit comprises at least one of a hot water circulating pump and heat rays, the at least one hardware processor is configured to determine the first received setting information received while the outdoor unit is operating in the cooling mode as the valid setting information.

16. The controller as claimed in claim 15, wherein upon the setting information being determined as invalid, the at least one hardware processor causes a user interface of the air conditioner to display a notification indicating that the setting information is invalid.

17. The controller as claimed in claim 16, wherein an operation of the air conditioning is one of a cooling operation, a heating operation, a dehumidification operation, and a blowing operation.

* * * * *